US011110361B2

(12) United States Patent
Schumacher et al.

(10) Patent No.: US 11,110,361 B2
(45) Date of Patent: Sep. 7, 2021

(54) CUSTOM FEEDBACK DEVICE

(71) Applicant: Laughable Toys, LLC, Snowmass, CO (US)

(72) Inventors: Michael Schumacher, Snowmass, CO (US); Philip Rowe, Denver, CO (US)

(73) Assignee: LAUGHABLE TOYS, LLC, Snowmass, CO (US)

( * ) Notice: Subject to any disclaimer, the term of this patent is extended or adjusted under 35 U.S.C. 154(b) by 0 days.

(21) Appl. No.: 16/520,142

(22) Filed: Jul. 23, 2019

(65) Prior Publication Data

US 2020/0016501 A1 Jan. 16, 2020

Related U.S. Application Data

(63) Continuation of application No. PCT/US2018/036035, filed on Jun. 5, 2018, and a continuation of application No. 29/613,597, filed on Aug. 11, 2017, now Pat. No. Des. 860,022.

(60) Provisional application No. 62/515,303, filed on Jun. 5, 2017.

(51) Int. Cl.

| | |
|---|---|
| ***A63H 1/00*** | (2019.01) |
| ***A63H 33/06*** | (2006.01) |
| ***A63H 33/08*** | (2006.01) |

(52) U.S. Cl.

CPC ..... *A63H 1/00* (2013.01); *A63H 33/062* (2013.01); *A63H 33/084* (2013.01); *A63H 33/088* (2013.01)

(58) Field of Classification Search

CPC ..... A63H 1/00; A63H 33/006; A63H 33/062; A63H 33/084; A63H 33/088

USPC ..... 446/102, 103, 120, 227, 486, 491; 482/44, 47, 49

See application file for complete search history.

(56) References Cited

U.S. PATENT DOCUMENTS

| | | | | |
|---|---|---|---|---|
| 4,003,144 | A * | 1/1977 | Maddestra | A63F 9/0098 434/403 |
| 4,645,471 | A | 2/1987 | Herring et al. | |
| 4,655,723 | A * | 4/1987 | Marason, Jr. | A63H 33/00 411/385 |
| 4,778,429 | A * | 10/1988 | Todokoro | A63H 23/00 446/153 |
| 4,813,404 | A | 3/1989 | Vallis | |
| 5,263,908 | A * | 11/1993 | Chen | A63B 23/12 482/127 |

(Continued)

OTHER PUBLICATIONS

International Searching Authority, International Search Report and Written Opinion, issued for International Application No. PCT/US2018/036035, dated Oct. 16, 2018 (13 pages).

(Continued)

*Primary Examiner* — Joseph B Baldori
(74) *Attorney, Agent, or Firm* — Polsinelli PC

(57) ABSTRACT

Implementations described and claimed herein provide systems and methods for delivering a customizable feedback stimulus. In one implementation, a custom feedback device comprises a shell housing having a first shell and a second shell. The shell housing opening extends between an outer surface of the first shell and an outer surface of the second shell. A plurality of protrusions extends between the first shell and the second shell, and at least one receiving area is defined by the plurality of protrusions between the first shell and the second shell. The receiving area is adapted to house a customized portion.

15 Claims, 30 Drawing Sheets

(56) References Cited

U.S. PATENT DOCUMENTS

| | | | | |
|---|---|---|---|---|
| 5,591,062 | A | 1/1997 | Hettinger | |
| 5,766,112 | A * | 6/1998 | Chuan | A63B 21/045 482/121 |
| 6,773,377 | B1 | 8/2004 | Yu et al. | |
| 7,044,827 | B1 * | 5/2006 | Krull | A63B 23/16 446/491 |
| 7,169,120 | B2 | 1/2007 | Murdock et al. | |
| 7,238,026 | B2 * | 7/2007 | Brown | G09B 1/36 434/258 |
| 8,454,483 | B1 * | 6/2013 | Bradley | A63B 21/072 482/44 |
| 8,540,545 | B2 * | 9/2013 | Leicht | A63H 33/04 446/118 |
| 8,636,624 | B2 * | 1/2014 | Liberman | A44C 9/003 16/110.1 |
| 8,920,209 | B2 | 12/2014 | Brooks et al. | |
| D840,254 | S | 2/2019 | Nguyen | |
| 2004/0237109 | A1 | 12/2004 | Dancel et al. | |
| 2009/0203294 | A1 * | 8/2009 | Kessin | A63H 33/006 446/486 |
| 2011/0245041 | A1 * | 10/2011 | Mayes | A63B 21/00069 482/44 |
| 2015/0246262 | A1 * | 9/2015 | Chiu | A63F 7/041 482/44 |
| 2015/0297955 | A1 * | 10/2015 | Silverglate | A63B 39/00 446/486 |

OTHER PUBLICATIONS

International Preliminary Report on Patentability issued in PCT/US2018/036035 dated Dec. 10, 2019, 9 pgs.

* cited by examiner

CUSTOM FEEDBACK DEVICE

CROSS-REFERENCE TO RELATED APPLICATIONS

The present application is a continuation of and claims the benefit of priority under 35 U.S.C. § 111 to International Patent Application No. PCT/US2018/036035, entitled "CUSTOM FEEDBACK DEVICE" and filed on Jun. 5, 2018, which claims the benefit of priority under 35 U.S.C. § 119(e) to U.S. Provisional Application No. 62/515,303, entitled "CUSTOM FEEDBACK DEVICE" and filed on Jun. 5, 2017. The present application is further a continuation of and claims the benefit of priority to U.S. Design Application No. 29/613,597, entitled "FEEDBACK DEVICE" and filed on Aug. 11, 2017.

Each of these applications is incorporated by reference in its entirety into the present application.

TECHNICAL FIELD

Aspects of the present disclosure relate to systems and methods for providing feedback stimulus to a user and more particularly to a feedback device providing a customizable feedback stimulus.

BACKGROUND

Fidgeting often occurs when a person is nervous, agitated, stressed, and/or bored and lacks a relief outlet. Particularly in the context of a classroom, meeting, presentation, or other quiet setting, fidgeting may be distracting to surrounding people. A common form of fidgeting involves repeated movement of a body part or an object. For example, a person may engage in pen-clicking, pen-tapping, or foot tapping as a form of fidgeting. These sorts of repeated movements generally create visual and audial distractions to nearby people.

Fidget devices aim to focus fidgeting and provide a relief outlet, thereby increasing attention and relieving the cause of the fidgeting. However, many of these conventional fidget devices are similarly distracting to surrounding people. For example, some conventional fidget devices are designed to spin rapidly within a user's hand, which creates a visual distraction to others. Exacerbating these problems, many conventional fidget devices are static in the type of stimulus they provide. One type of stimulus, such as a clicking motion, may provide relief to some users but not others. Further, conventional fidget devices having a static set of one or more types of stimulus often lose value in being a relief outlet. A user may become bored with a stimulus type, or the stimulus type may otherwise become no longer stimulating to the user. In such situations with conventional static fidget devices, the user often resorts to other distracting fidgeting or behavior.

It is with these observations in mind, among others, that various aspects of the present disclosure were conceived and developed.

SUMMARY

Implementations described and claimed herein address the forgoing problems, among others, by providing systems and methods for delivering a customizable feedback stimulus. In one implementation, a custom feedback device comprises a shell housing having a first shell and a second shell. The shell housing opening extends between an outer surface of the first shell and an outer surface of the second shell. A plurality of protrusions extends between the first shell and the second shell, and at least one receiving area is defined by the plurality of protrusions between the first shell and the second shell. The receiving area is adapted to house a customized portion.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTION OF THE DRAWINGS

FIG. 6A shows the two shells aligned for coupling and FIG. 6B shows the shells coupled and locked together.

FIGS. 23C-F are top views of a circular device, a first square device, and a second square device, respectively.

DETAILED DESCRIPTION

Aspects of the present disclosure involve a customizable handheld device providing varying levels of customizable stimulation to a user. In one aspect, the device includes one or more inserts and one or more free-spinning corners housed inside a shell. The shell may be separable into a plurality of portions. For example, the shell may be made of two identical shell pieces that snap and lock together by hand. No fasteners are needed to assemble or disassemble the device. The device may be shaped and sized for one handed use and accommodates a large range of hand sizes. A center opening defined in the device provides feedback and allows smaller hands to also comfortably grasp the device. The shell provides further stimulus through its raised surfaces, textures, and cutouts on the surface.

The inserts and corners provide stimulus to a user, and each insert and corner may provide a different type of stimulus customizable for a particular user. One insert may have a joystick a user can maneuver with their thumb while another insert may have a raised track a user can trace with their finger. Likewise, the free-spinning corners provide a stimulus themselves but may provide another level of feedback by having different shaped surfaces and textures. One corner can have raised ridges along the entirety of the corner while another corner may have a swirling ridge extending from the top to the bottom of the corner. Various other non-limiting examples of inserts and corners in addition to these are described herein.

Figure 1:
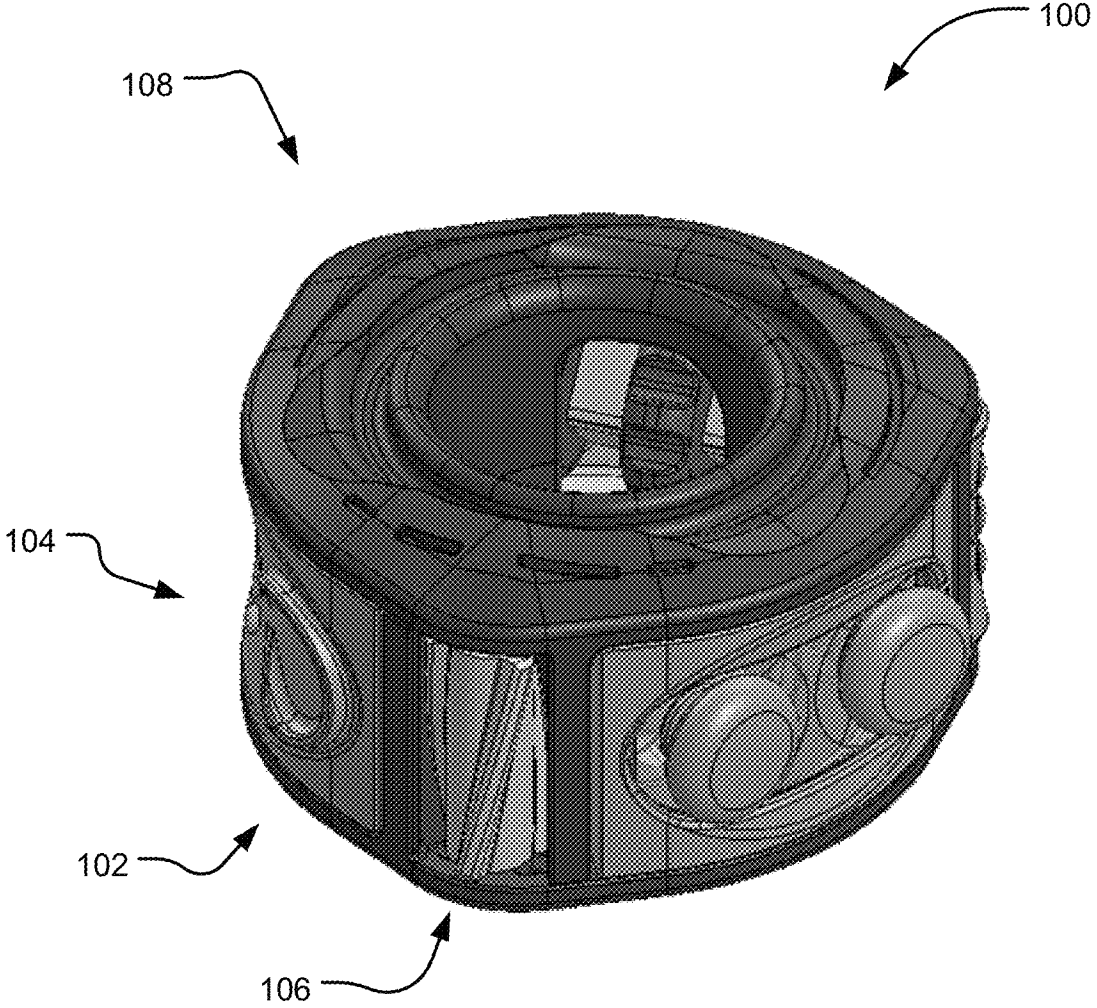
FIG. 1 is an isometric view of a custom feedback device.

Referring to the drawings, FIG. 1 is an isometric view of an example custom feedback device 100. The device 100 includes a plurality of shells 102 snapped together to create a shell housing 108 and a plurality of releasable inserts 104 and corners 106 housed on the outer portion of the shell housing 108. The shells 102 can be taken apart to release the releasable inserts 104 and corners 106, allowing the releasable inserts 104 and corners 106 to be replaced with releasable inserts 104 and corners 106 of different feedback surfaces or stimuli.

The releasable inserts 104 are housed within the shell housing 108 via a ridge on both the top and bottom of each releasable insert 104 which are received into a corresponding grove on each shell 102. The ridge and groove prevent the releasable insert 104 from moving forward and out of the shell housing 108 or inward into the shell housing 108. Each shell 102 further provides side walls abutting either side of the releasable inserts 104, which when each shell 102 is brought together, seals the releasable insert 104 within the shell housing 108. Additionally, each releasable corner 106 has a center opening configured to receive a post of each shell 102 on either end of the releasable corner 106, allowing the releasable corner 106 to spin freely. When the two shells 102 are apart, each releasable insert 104 can be placed in a first shell 102, where the grooves, ridges, and bottom planar surface will keep each releasable insert 104 upright, and a side wall of the shell 102 will hold each releasable insert 104 in place. Each releasable corner 106 can then be placed on a post. After each releasable insert 104 and corner 106 are in place, the second shell 102 is aligned with the first shell 102, releasable inserts 104, and releasable corners 106, and pushed down to lock the entire device 100 together. An example implementation will be used throughout the specification having two shells 102, three releasable inserts 104, and three releasable corners 106. It will be appreciated that the device 100 can include any number and combination of releasable inserts 104 and releasable corners 106 housed in one or more shells 102.

Figure 2B:
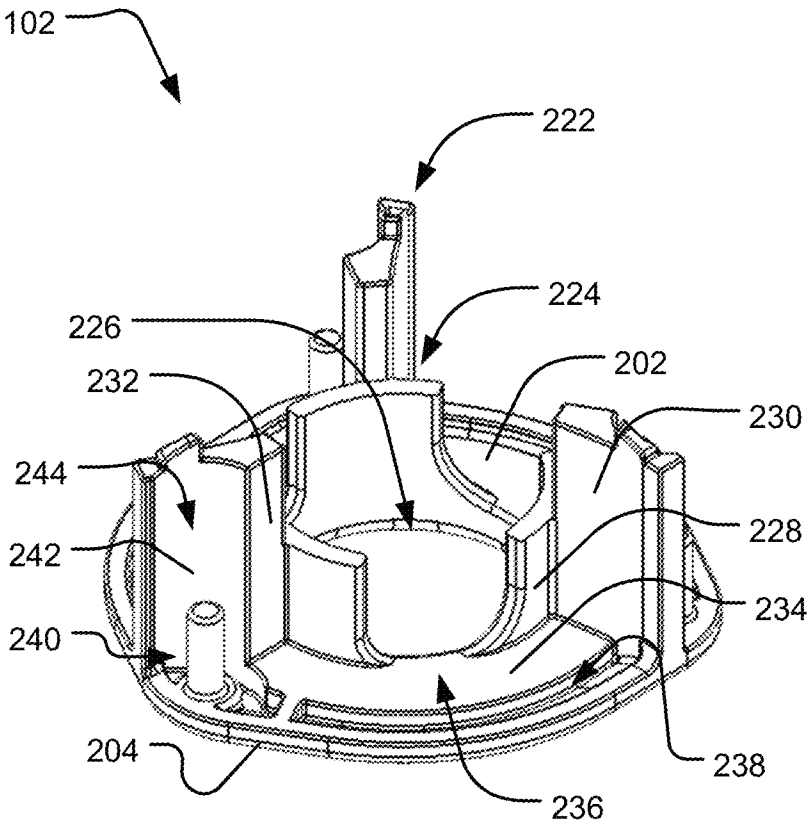
FIGS. 2A-B are isometric top and bottom views, respectively, of a shell.
Figure 2A:
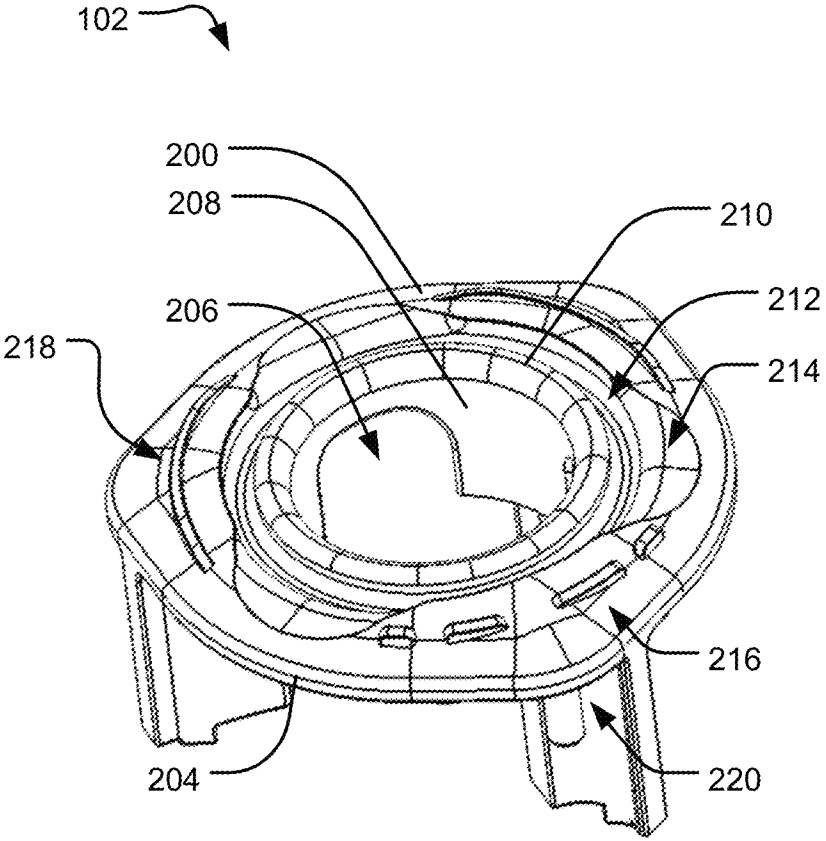

Turning to the outer housing first, FIGS. 2A-B are an isometric top and bottom view, respectively, of a singular shell 102, illustrating the main components for coupling two shells 102 together and housing the plurality of releasable inserts 104 and corners 106 in the shells 102. The shell 102 is generally circular shaped with an outer surface 200 and an inner surface 202 extending to a shell edge 204. The shell 102 also has a shell opening 206 having a shell opening surface 208 and a shell opening lip 210 creating a liner groove 212 to accommodate a liner 1200, discussed in more detail below. The outer surface 200 may have a series of raised or depressed features to provide additional surface stimuli. For example, a plurality of petals 214, a shell etching pattern 216, and a plurality of etched lines 218 can be placed on the outer surface 200 and provide a textured surface and raised portions that can be traced by a user's fingers.

Turning to the inner portion of the shell 102, shown in FIG. 2B, a single shell 102 generally contains half of the surfaces and areas formed for housing a releasable insert 104 or corner 106. When the two shells 102 are combined, the half portions combine to create singular areas for a releasable insert 104 or corner 106. Starting with a plurality of insert areas 236, a plurality of protrusions 222 extend from the inner surface 202 near a plurality of rounded edges 220, shown in FIG. 2A, and partially define a plurality of receiving areas, such as insert areas 236 or corner areas 244, adapted to house a customized portion, such as the insert 104, the corner 106, and/or the like. The protrusions 222 provides side walls to hold the plurality of releasable inserts 104 in place and also provides a means of coupling the shells 102 together. An inner cylindrical wall 224 further defines the plurality of insert areas 236 and includes an insert backing opening 226. Each shell 102 has half of an inner cylindrical wall 224 and half of an insert backing opening 226. When two shells 102 are coupled together to create a shell housing 108, each inner cylindrical wall 224 of each shell 102 mates and creates a solid wall with one insert backing opening 226, which may be in the shape of an oval. When an insert 104 is in the insert area 236, the insert backing opening 226 provides access to the backside of an insert, which may be a hard or soft material providing an additional feedback surface.

The insert area 236 is more specifically defined by a curved insert backing surface 228 of the inner cylindrical wall 22 and a planar insert side surface 230 of a protrusion 222. The planar insert side surface 230 provides both the left and right side wall, which are interchangeable, for the insert area 236 such that when two shells 102 are coupled, the insert side surface 230 of a first shell 102 will be one side of the insert area 236 and the insert side surface 230 of a second shell 102 will be the opposite side of the insert area 236. An insert first surface 234 of the inner surface 202 provides both the top and bottom surface, which are also interchangeable, for the releasable insert 104 to rest on. Furthermore, the insert first surface 234 includes an insert receiver 238 configured to receive and hold the releasable insert 104. The insert receiver 238 may be a groove, as shown, but may also be various other designs such as holes, latches, adhesion, or the like.

Adjacent to each insert area 236 is a corner area 244. The corner area 244 is defined by a curved corner backing surface 242 of the protrusion 222. Much like the surfaces of the insert area 236, the curved corner backing surface 242 is half of the corner area 244. When two shells 102 are coupled, a mating surface 232 on both shells 102 mate and each corner backing surface 242 connects to create one curved corner backing surface 242. The curved corner backing surface 242 may be cylindrically shaped. Within each corner area 236, a post 240 protrudes from the inner surface 202 and is configured to hold a corner 106 in place within the device 100. The corner post 240 may be cylindrical, as shown, or may be other shapes such as rectangular, triangular, or the like.

Figure 3A:
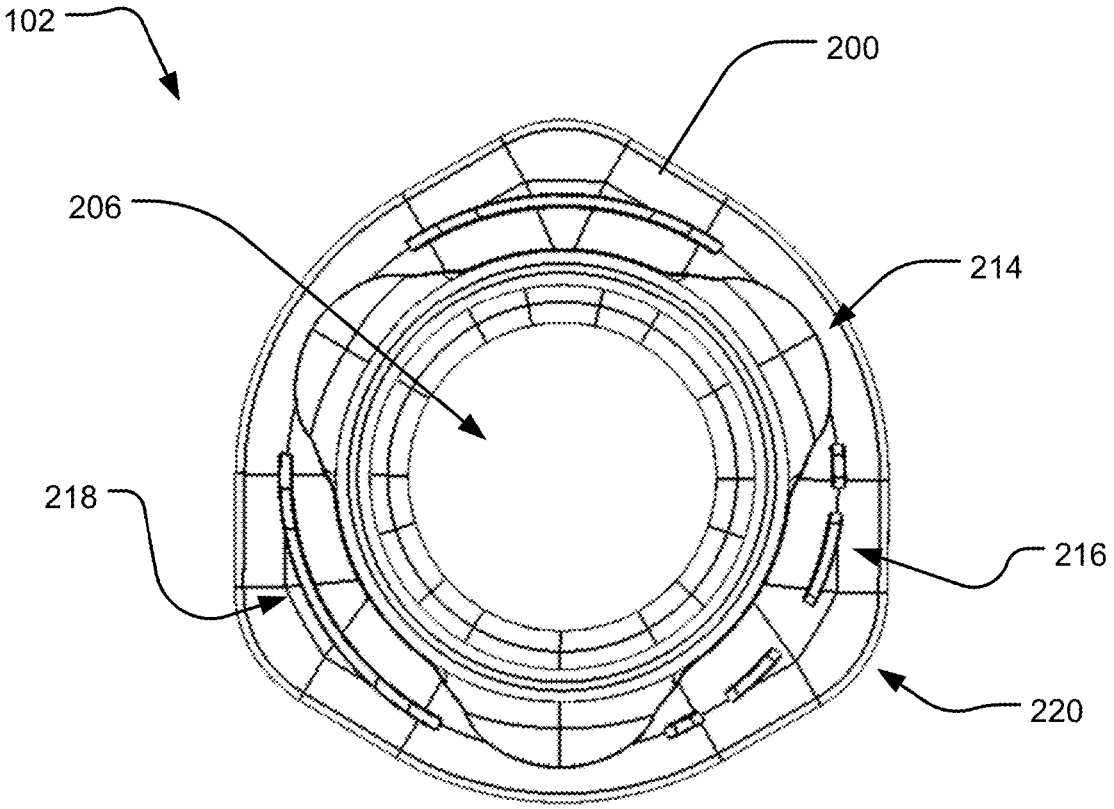
FIGS. 3A-B are a top view and side view, respectively, of the shell.
Figure 3B:
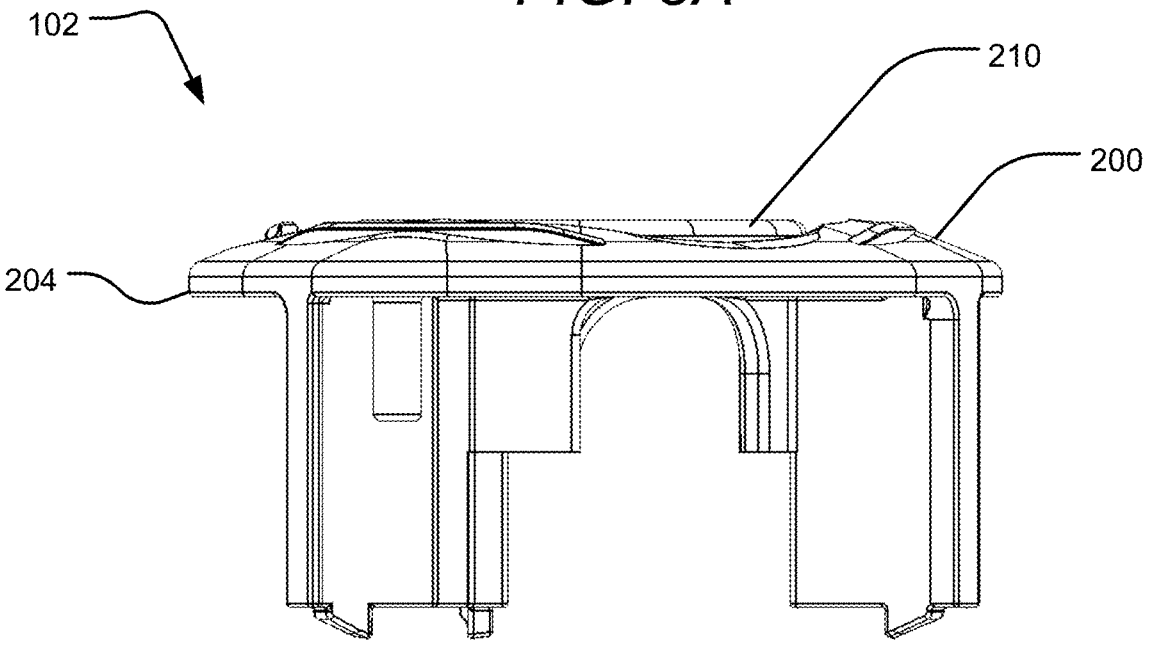

FIGS. 3A-B are a top and side view, respectively, of the shell 102, highlighting the textured and raised features of the outer surface 200 of the shell 102. The outer surface 200 may contain features to provide additional stimuli such as patterned etchings, raised lines, or the like. In one implementation the features include three petals 214 positioned between each rounded edge 220. The petals 214 are distinct from the outer surface 200 and contain an edge which breaks the surface and provides a sensation to a finger tracing the outer surface 200. The shell 102 also includes one raised pattern 216 and two raised lines 218 positioned between each petal 214. Similar to the petals 214, the raised pattern 216 and lines 218 provide a sensation of disruption to the surface and provide separate ridges for a finger to trace. Although the pattern 216 and lines 218 are raised in the implementation shown, it will be appreciated that the pattern and lines may also be etched and depressed or a combination of depressed and raised.

Turning the shell 102 from a top view to a side view, FIG. 3B illustrates the shape of outer surface 200 of the shell 102. The outer surface 200 may be generally planar and convexly shaped near the edge 204. The device 100 can be held in one hand and is sized to fit comfortably in a variety of hand sizes. The shell opening 206 accommodates smaller hand sizes as a user can use the opening 206 to grasp or hook the device 100 with one or more fingers. The shell 102 may be made of plastic, metal, or other similar materials and may be three-dimensionally (3-D) printed, machined, injection molded, or by other means of manufacturing.

Figure 4A:
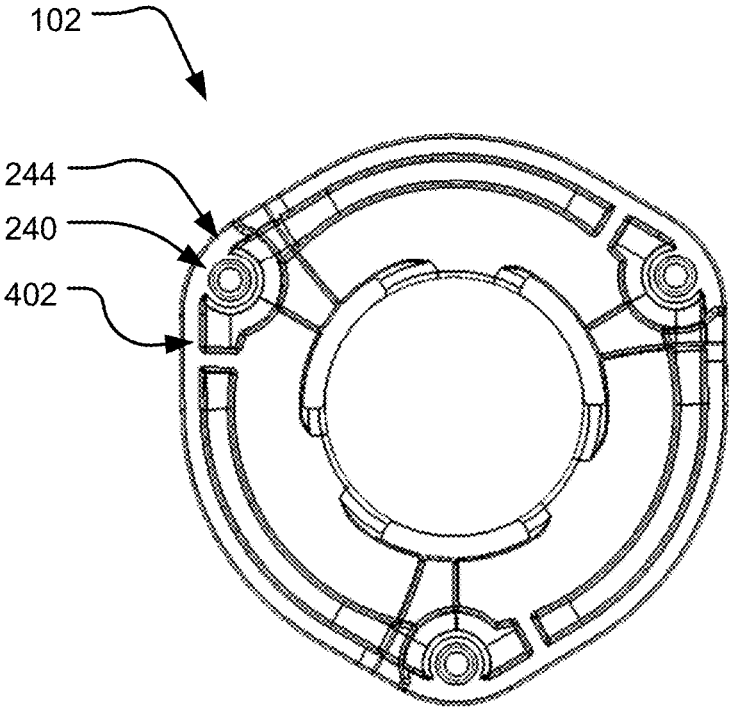
FIGS. 4A-B are a bottom view and alternative side view, respectively, of the shell.
Figure 4B:
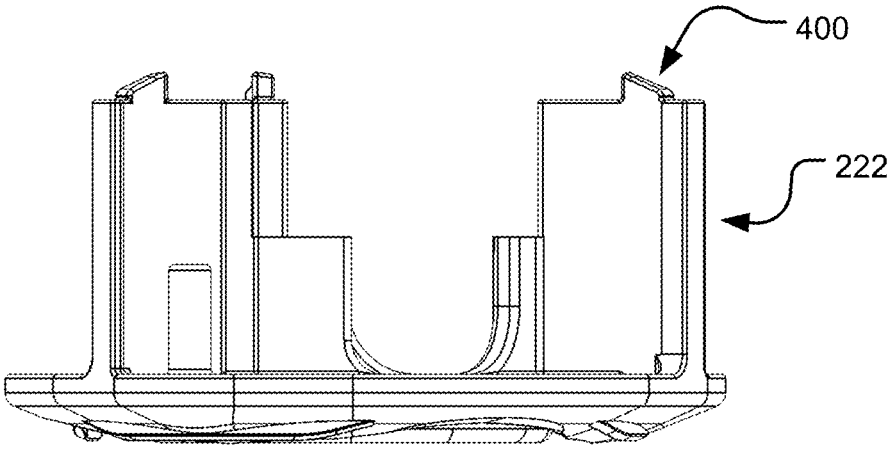
Figure 5C:
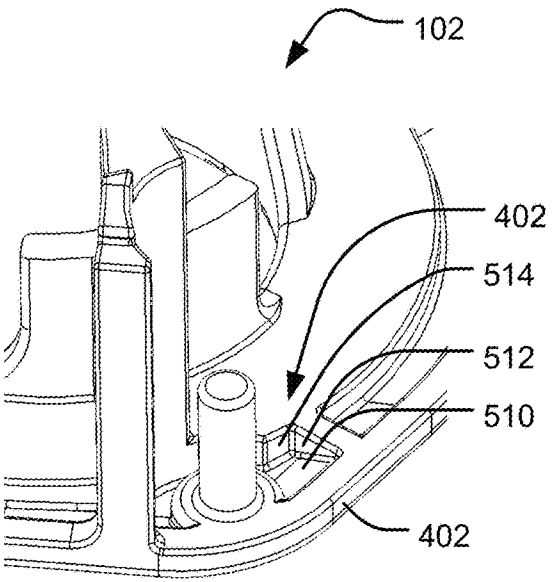
FIGS. 5A-C are detailed first, second, and third isometric views, respectively, of a coupler and a receiver of the shell.
Figure 5B:
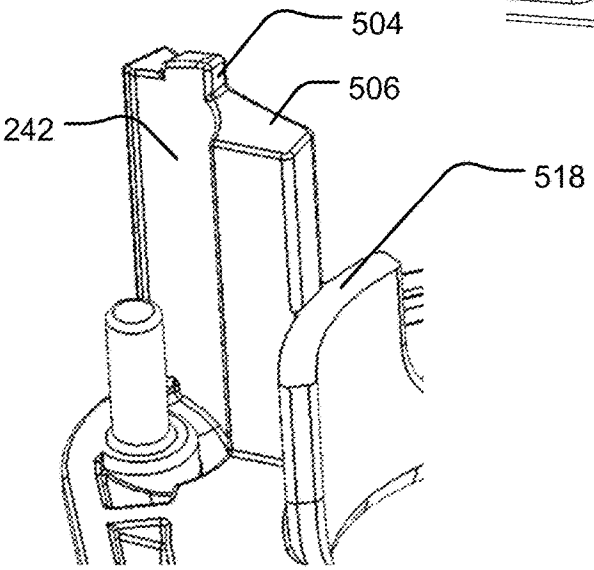
Figure 5A:
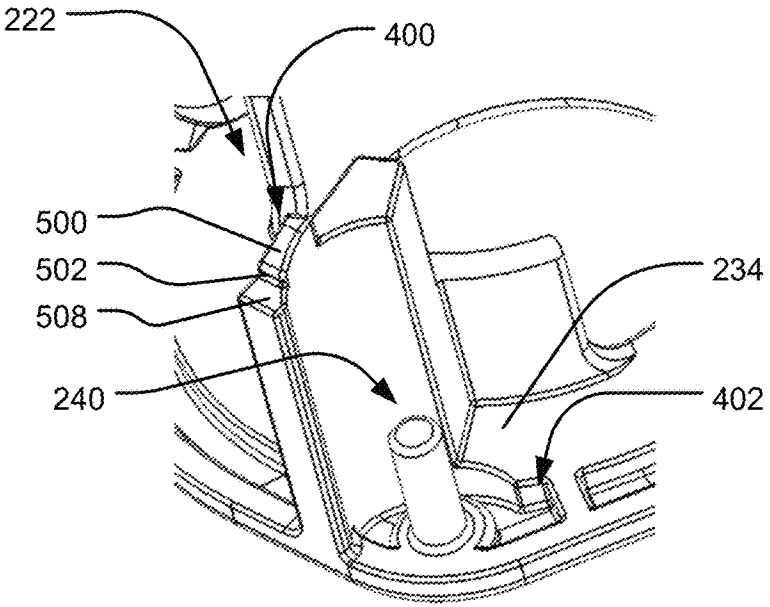

Continuing to turn the shell 102 from a side view to a bottom view and an alternative side view where the outer surface is facing down, FIGS. 4A-B are a bottom and alternative side view, respectively, of the shell 102, highlighting a coupler 400 and a receiver 402 of the shell 102. The receiver 402, shown in FIG. 4A, is positioned, near each corner post 240 and configured to receive a coupler 400, shown in FIG. 4B, of each protrusion 222. The receiver 402 may be an indented tab outside the perimeter of the corner area 244. The coupler 400 is positioned on the end of each protrusion 222 and is configured to be received in the receiver 402. The coupler 400 may be triangular and complementary to the receiver's shape. FIGS. 5A-5C details the mechanics of the coupler 400 and receiver 402.

Turning to FIGS. 5A-C, a detailed first, second, and third isometric view, respectively, of the coupler 400 and receiver 402 are shown. The coupler 400 positioned at the end of the protrusion 222 includes a coupler first surface 500 flanked by a coupler second surface 502, shown in FIG. 5A, and couple third surface 504, shown in FIG. 5B. The coupler 400 breaks the protrusion surface into a protrusion first 506 and second 508 surface both adjacent to the coupler 400. In one implementation, the coupler 400 may be in the shape of a triangular tab. Turning to FIG. 5C, the receiver 402 is made of a receiver first surface 510 starting near the edge 204 and angling down into the shell 102. A receiver second surface 512 and receiver third surface 514 are both perpendicular to each other and perpendicular to the first surface 510. When the shells 102 are coupled together and the receiver 402 receives the coupler 400, the coupler first surface 500 contacts the receiver first surface 510 and the coupler third surface 504 contacts the receiver third surface 514. Furthermore, the protrusion first 506 and second 508 surfaces contact the insert first surface 234. When the two shells 102 are coupled, the insert area 236 and corner area 244 are completed as various surfaces mate and come together to define each area. For example, a cylindrical flat surface 518 of the first shell 102 contacts the same cylindrical flat surface 518 of the second shell 102, completing the insert backing surface 228. The insert area 236 and corner area 244 are illustrated and highlighted in the shell housing 108, shown in the next figures.

Figure 6B:
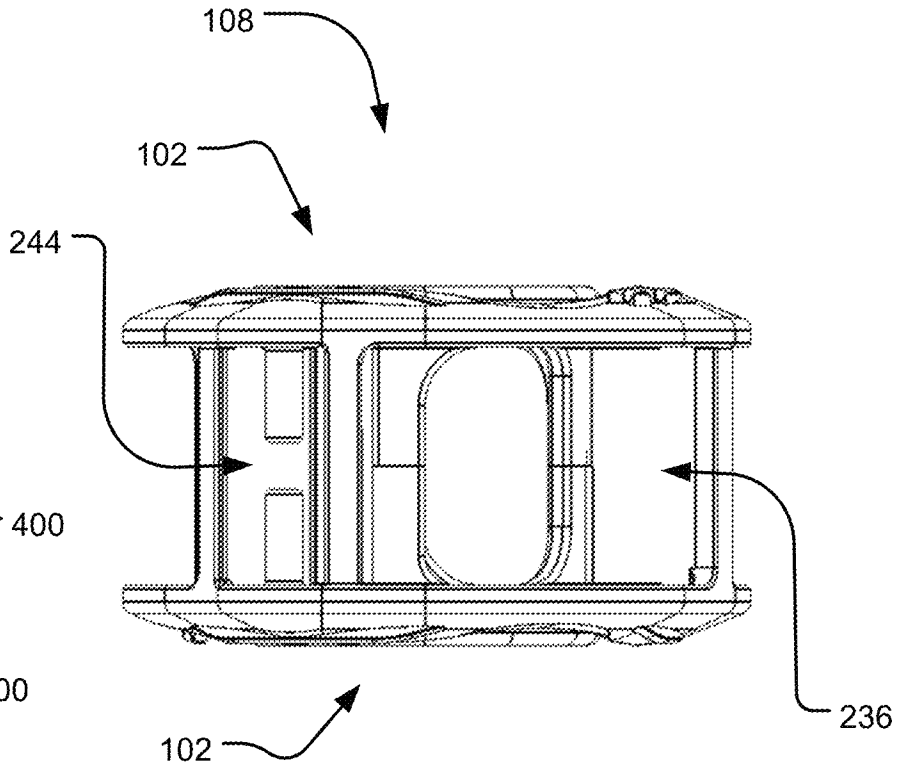
FIGS. 6A-B are an isometric view and side view, respectively, of the two shells coupling.
Figure 6A:
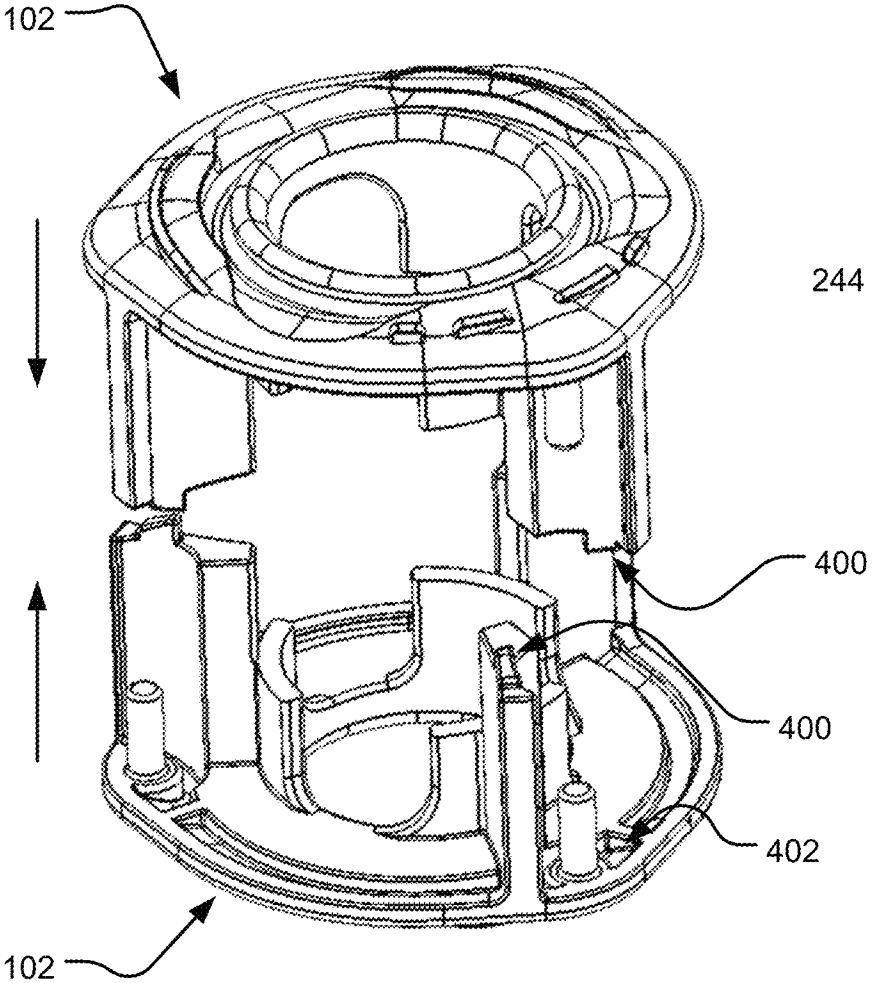

FIGS. 6A-B are an isometric view of two shells 102 coupling and a side view of the shell housing 108, respectively. In FIG. 6A, the two shells 102 are aligned such that each coupler 400 will be received into each receiver 402 when the shells 102 are brought together in the direction shown by the arrows. An external force on the outer surface 200 of either both shells 102 or one shell 102 will couple the shells 102 together creating a shell housing 108. The shells 102 lock together via a friction fit between the couplers 400 and the receivers 402 without the use of additional fasteners or adhesions. Additionally, the shells 102 can be disassembled simply by pulling the shells 102 apart from each other in the opposite direction of the arrows shown in FIG. 6A. FIG. 6B highlights the insert areas 236 and corner areas 244. As shown, the insert area 236 is closed off except for the outer opening to provide access to the releasable insert 104 and the insert backing opening 226. The area may be shaped to be a curved rectangle to accommodate a releasable insert 104 of the same or similar shape. The corner area 244 is also mostly closed off except for an opening to provide access to the releasable corner 106.

Figure 7B:
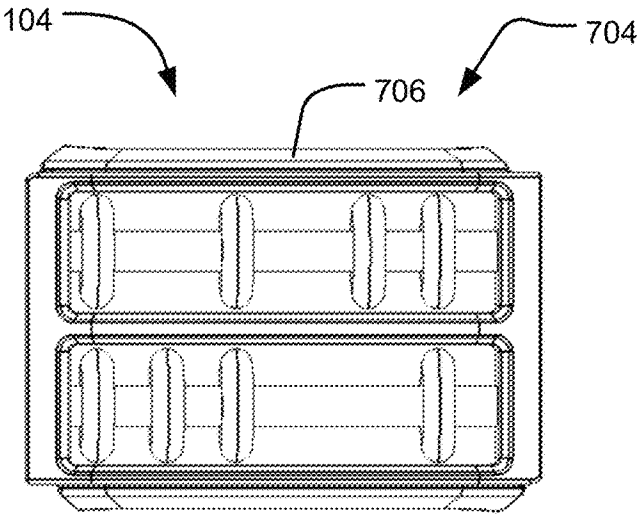
FIGS. 7A-C are isometric, front, and rear views, respectively, of a releasable insert.
Figure 7C:
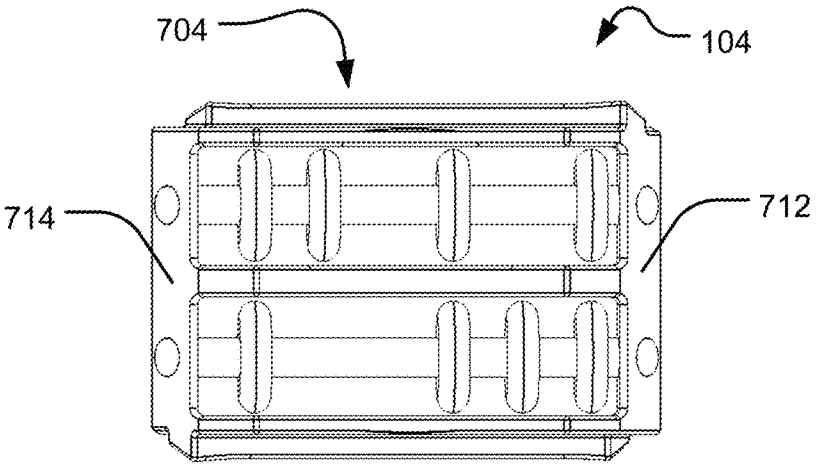
Figure 7A:
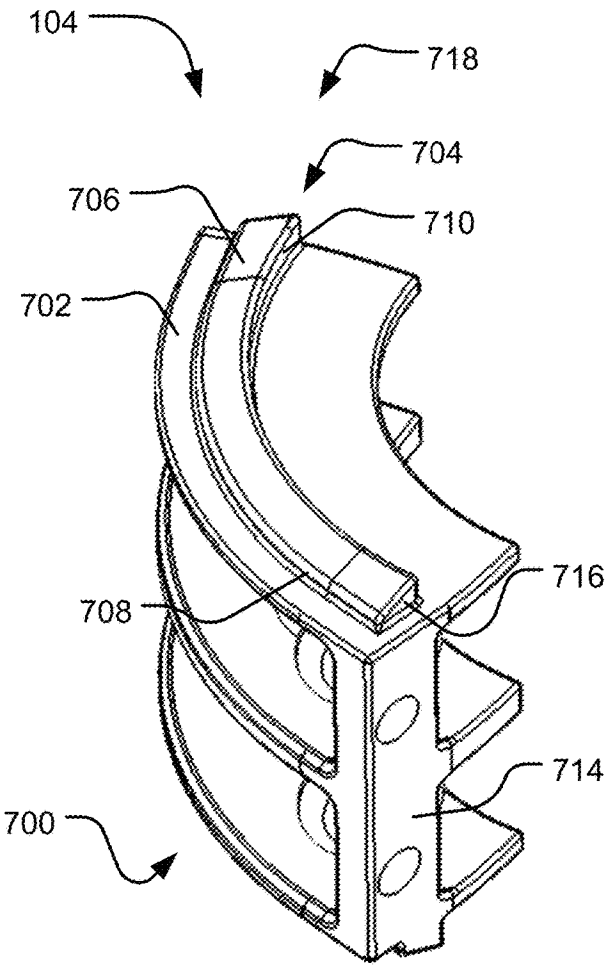

FIGS. 7A-C are an isometric, front, and rear view, respectively, of the releasable insert 104 and details a coupler 718 of the releasable insert 104. The coupler 718 is configured to allow the insert 104 to couple to the shell 102 in a releasable manner. As shown in FIG. 7A, the insert 104 is generally rectangular shaped and curves when looking at the insert 104 from above or below. The insert 104 includes a feedback surface 700 on its face and the coupler 718 on a top surface 702. The feedback surface 700 may be any surface or device which provides a stimulus; example implementations will be discussed more below. In an example implementation, the coupler 718 is a ridge 704. The ridge 704 includes a ridge first surface 706 on the top of the ridge 704 and a ridge second surface 708 extending off of one end of the ridge first surface 706 and a third 710 surface extending off of the opposite end of the ridge first surface 706. The third surface 710 is thicker than the second surface 708 such that the first surface 706 is tilted downwards towards the feedback surface 700. The ridge 704 is flush on one side with an insert first side 712 and ends before it reaches an insert second side 714 on the opposite side, creating a ridge side surface 716. The insert first side 712 is identical to the insert second side 714 except that it is mirrored and flipped. The insert 104 also contains an identical ridge 704 on the opposite side, except that the ridge 704 is mirrored and flipped, as shown in FIG. 7C. In one implementation, the ridge 704 is complementary to the insert receiver 238 of the shell 102, as shown in the next set of figures.

Figure 8B:
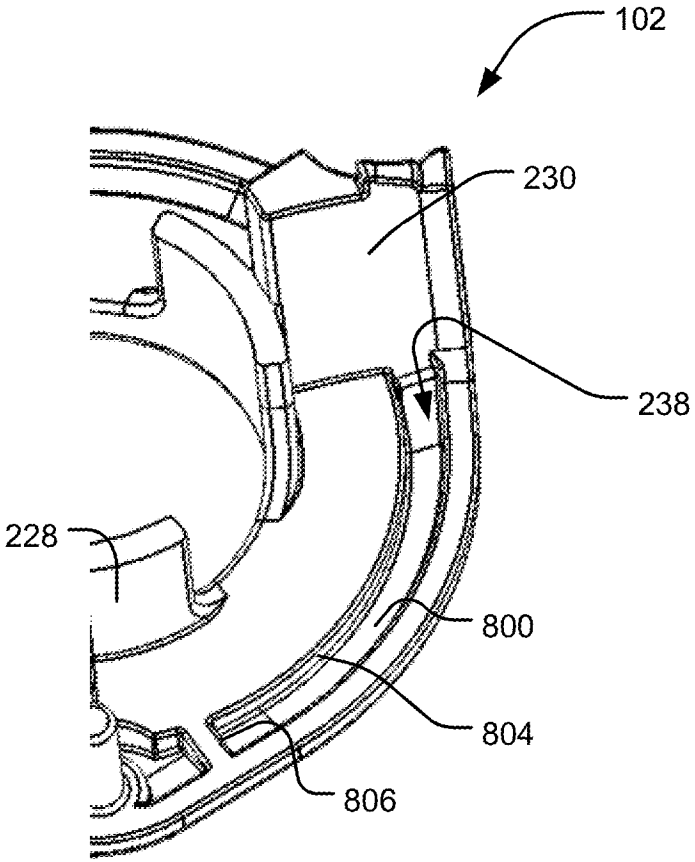
FIGS. 8A-B are a side cross-section view and isometric view, respectively, of the shell and an insert receiver.
Figure 8A:
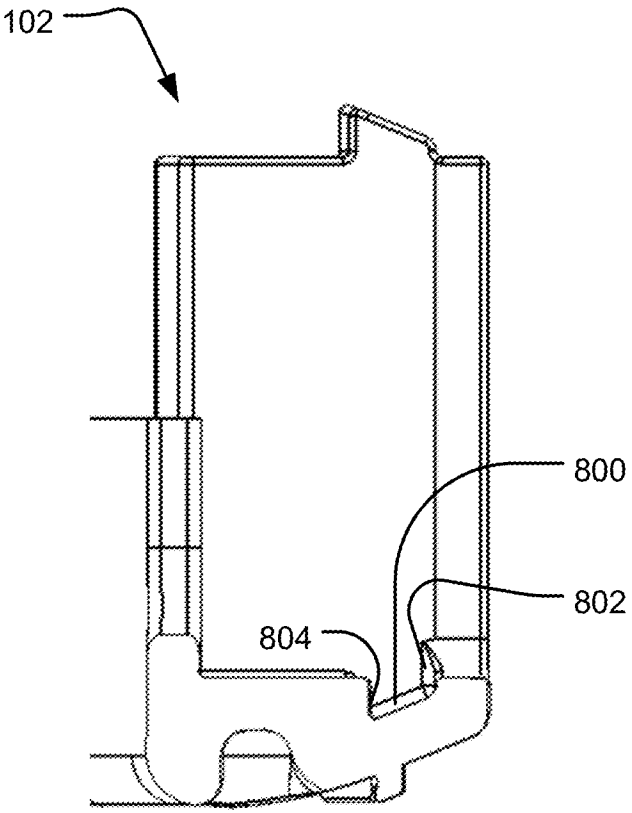

FIGS. 8A-B are a side cross-section and an isometric view, respectively, of the shell 102, detailing the insert receiver 238. In an example implementation, the insert receiver 238 is shaped as a curved groove to receive the curved ridge 704 of the releasable insert 104 shown in FIG. 7A. A receiver first surface 800 is tilted to match the tilted ridge first surface 706. A receiver second surface 802 and third surface 804 further define the front and rear portion of the groove, which also contact the ridge second surface 708 and third surface 710, respectively, and prevent the insert 104 from moving forwards out of the device 100 or backwards and into the device 100. A ridge third surface 806 and the insert first side surface 230 complete the groove and prevent the insert 104 from moving sideways within the device 100. When the releasable insert 104 is ready to be installed in the device 100, the releasable insert 104 is aligned with the shells 102 such that the ridge 704 is received into the insert receiver 238.

Figure 9B:
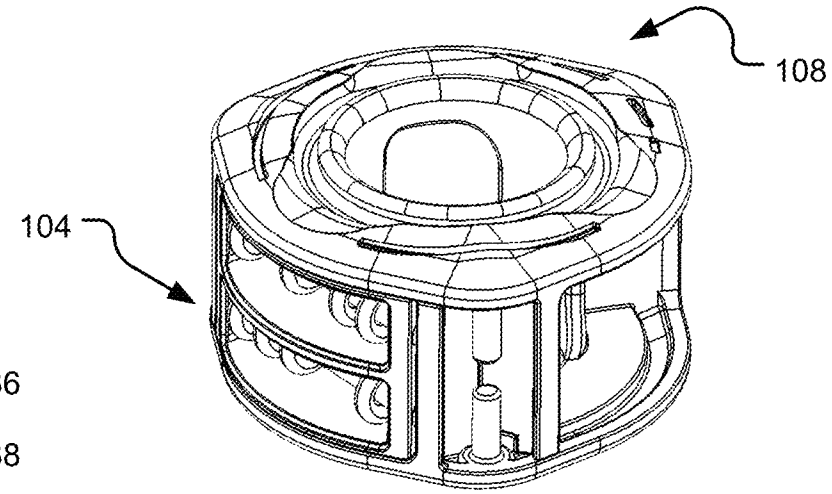
FIGS. 9A-B are isometric views of two shells and a releasable insert aligned for coupling and the shells and releasable insert coupled, respectively.
Figure 9A:
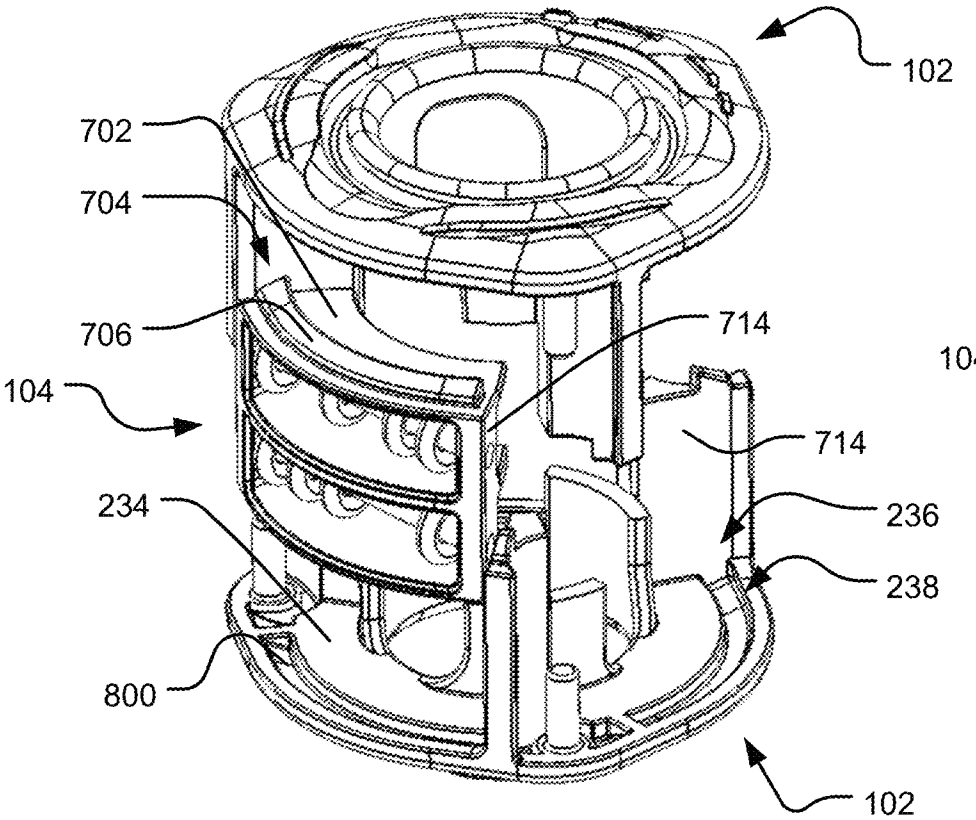

FIGS. 9A-B are an isometric view of two shells 102 and a releasable insert 104 aligned for coupling and the shells 102 and releasable insert 104 coupled, respectively. When the releasable insert 104 is aligned with the shell 102, the insert second side 714 will contact the insert first side surface 230, as shown in FIG. 9A. As the two shells 102 and releasable insert 104 are brought closer together, the releasable insert 104 begins entering the insert area 236. The insert receiver 238 will also begin receiving the ridge 704 and the ridge first surface 706 will contact the receiver first surface 800. When the shells 102 and releasable insert 104 are fully locked together the insert top surface 702 will contact the insert first surface 234. As shown in FIG. 9B, the releasable insert 104 is locked in place in the shell housing 108 and cannot fall out or be removed without taking the shells 102 apart. Although the releasable insert 104 was shown to be aligned simultaneously with both shells 102 at the same time, as shown in FIG. 9A, the releasable insert 104 can be first inserted into one shell 102. The ridge 704 in the insert receiver 238 and the planar surface of the insert first surface 234 may hold the releasable insert 104 upright until the second shell 102 is brought down onto the first shell 102 and releasable insert 104 to create a shell housing 108 and device 100. Although only one releasable insert 104 is shown being installed, multiple releasable inserts 104 can be installed simultaneously.

Figure 10B:
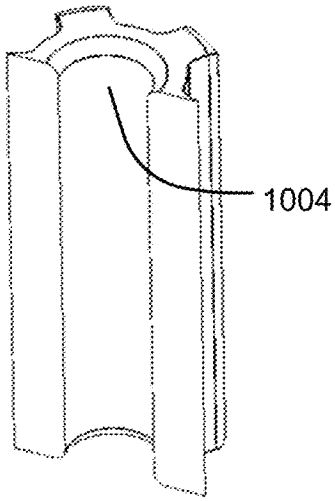
FIGS. 10A-C are isometric, isometric cross-section, and top views, respectively, of a releasable corner.
Figure 10C:
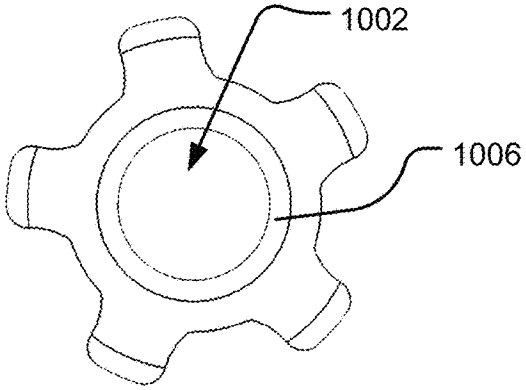
Figure 10A:
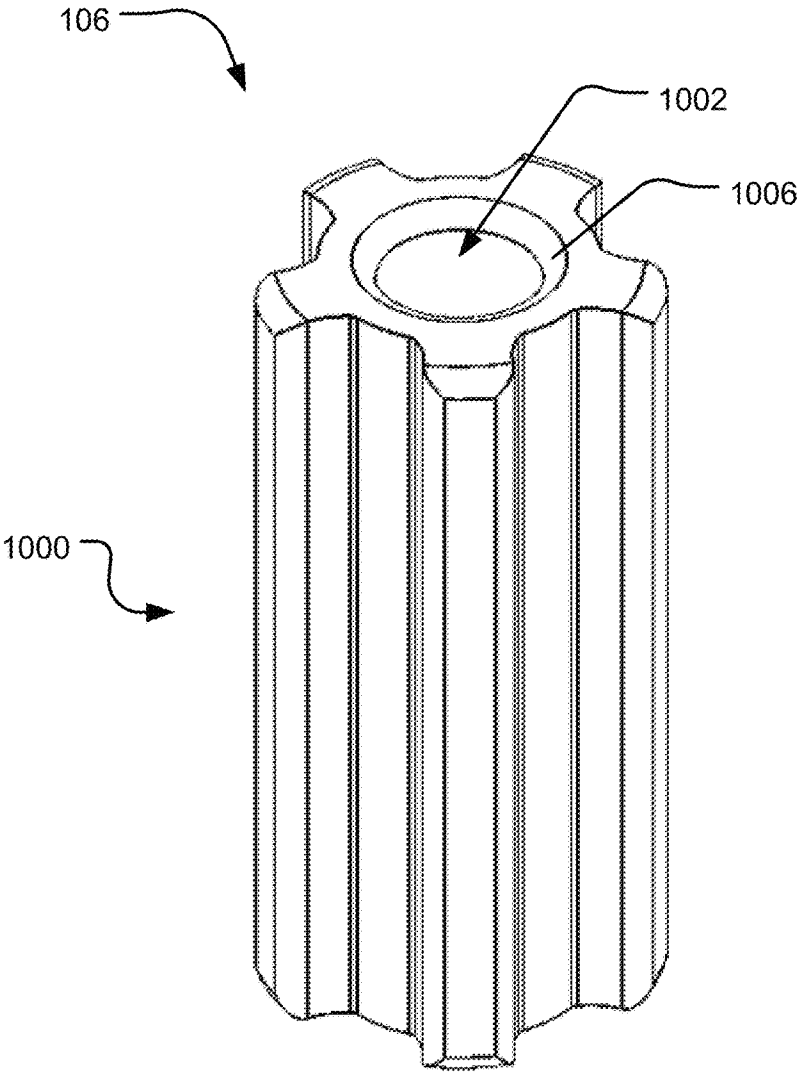

Referring to FIGS. 10A-C, an isometric, isometric cross-section, and top view, respectively, of a releasable corner 106 are shown. The releasable corner 106 is generally cylindrical with a feedback outer surface 1006. Each releasable corner 106 may provide a different stimulus based on the type of feedback outer surface 1000 presented. In an example implementation the feedback outer surface 1000 is made of five raised ridges spaced equidistantly around the releasable corner 106, as shown. The releasable corner 106 also includes a corner center hole 1002 having a corner inner surface 1004. The releasable corner 106 receives a corner post 240 on each end of the releasable corner 106 and is allowed to spin freely. A corner bevel 1006 aids in a smoother spin. The releasable corner 106 can be made of plastic, metals, rubber, or the like. Each material provides a different surface and temperature stimulus. For example, an aluminum surface will generally be smooth and cool to the touch while a rubber surface may be slightly rough and room temperature. When the releasable corners 106 are ready for installation, the releasable corners 106 are aligned with two shells 102, as shown in the next figures.

Figure 11A:
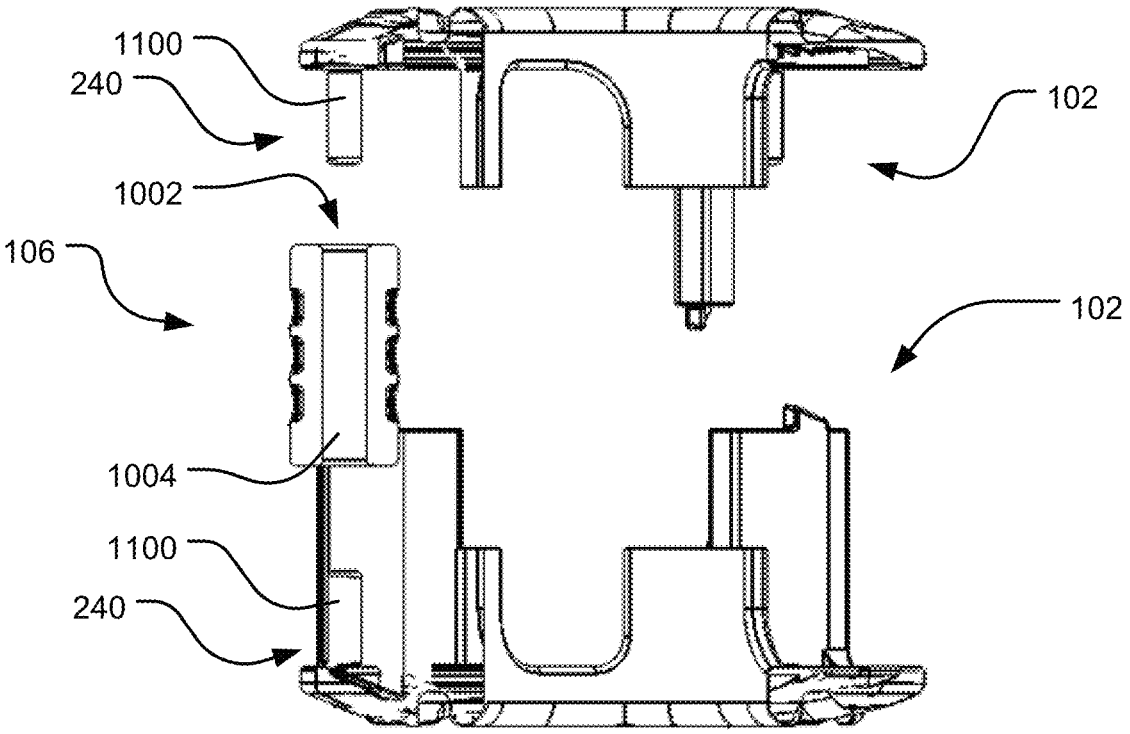
FIGS. 11A-B are \ side cross-section views of the corner and shells aligned for coupling and the corner and shells coupled, respectively.
Figure 11B:
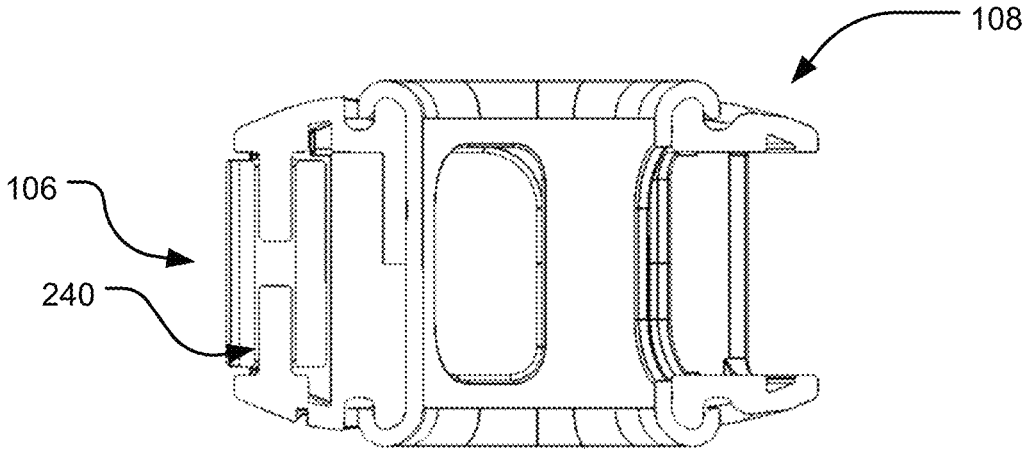

FIGS. 11A-B are a side cross-section of the releasable corner 106 and two shells 102 aligned for coupling and the releasable corner 106 and shell housing 108, respectively. In FIG. 11A, the releasable corner 106 is aligned with the corner post 240 such that the two corner posts 240 will enter the corner center hole 1002 on either side of the releasable corner 106 and lock the corner 106 into the shells 102, shown in FIG. 11B. When the corner 106 is locked in the shell housing 108, a partial section of the corner inner surface 1004 contacts the two corner surfaces 1100 at each end of the corner 106. A minimal gap between the corner post 240 and the corner 106 allows the corner 106 to spin freely around the post 240, as shown in FIG. 11B. Much like the releasable insert 104, although the releasable corner 106 was shown to be aligned simultaneously with both shells 102 at the same time, as shown in FIG. 11A, the releasable corner 106 can be installed and held in place on a post 240 on one shell 106 while the second shell 102 is brought down on top of the first shell 102 and releasable corner 106 to create a shell housing 108 and device 100. Although only one releasable corner 106 is shown being installed, multiple releasable inserts 104 can be installed simultaneously. After the releasable inserts 104 and releasable corners 106 are each installed into a shell housing 108, the device 100 is complete and ready for use. An additional and a liner 1200 can be provided with the device 100, but is not necessary to complete the device 100.

Figure 12B:
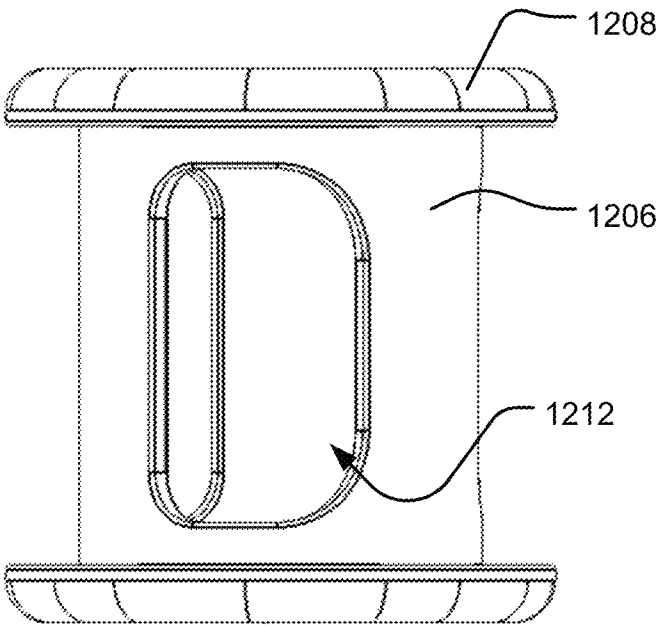
FIGS. 12A-B are an isometric view and side view, respectively, of a liner.
Figure 12A:
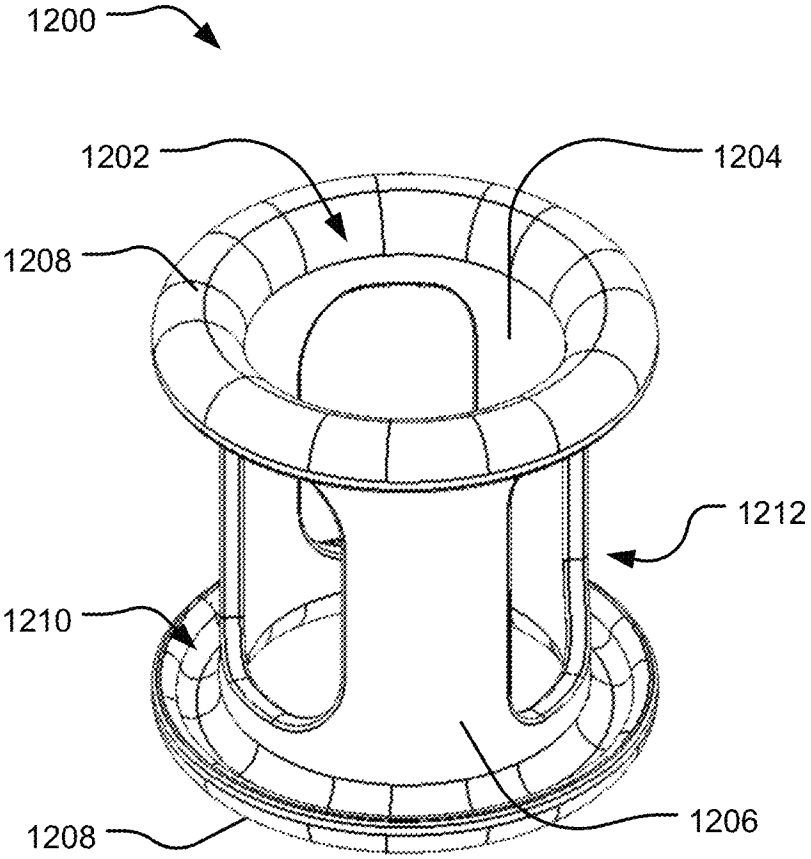

FIGS. 12A-B are an isometric and side view, respectively, of the liner 1200. The liner 1200 is generally cylindrical shaped and includes a liner center hole 1202 with an inner surface 1204. The center hole 1202 includes a lip 1208 that curves outward to define a channel groove 1210. The liner 1200 also has an outer surface 1206 with at least one liner opening 1212. In an example implementation, the liner 1200 has three liner openings 1212 spaced equidistant around the liner 1200 and aligns with the insert backing openings 226 of a shell housing 108. The liner 1200 is made of a flexible material such as silicon, rubber, or the like and provides an additional feedback surface.

Figure 13:
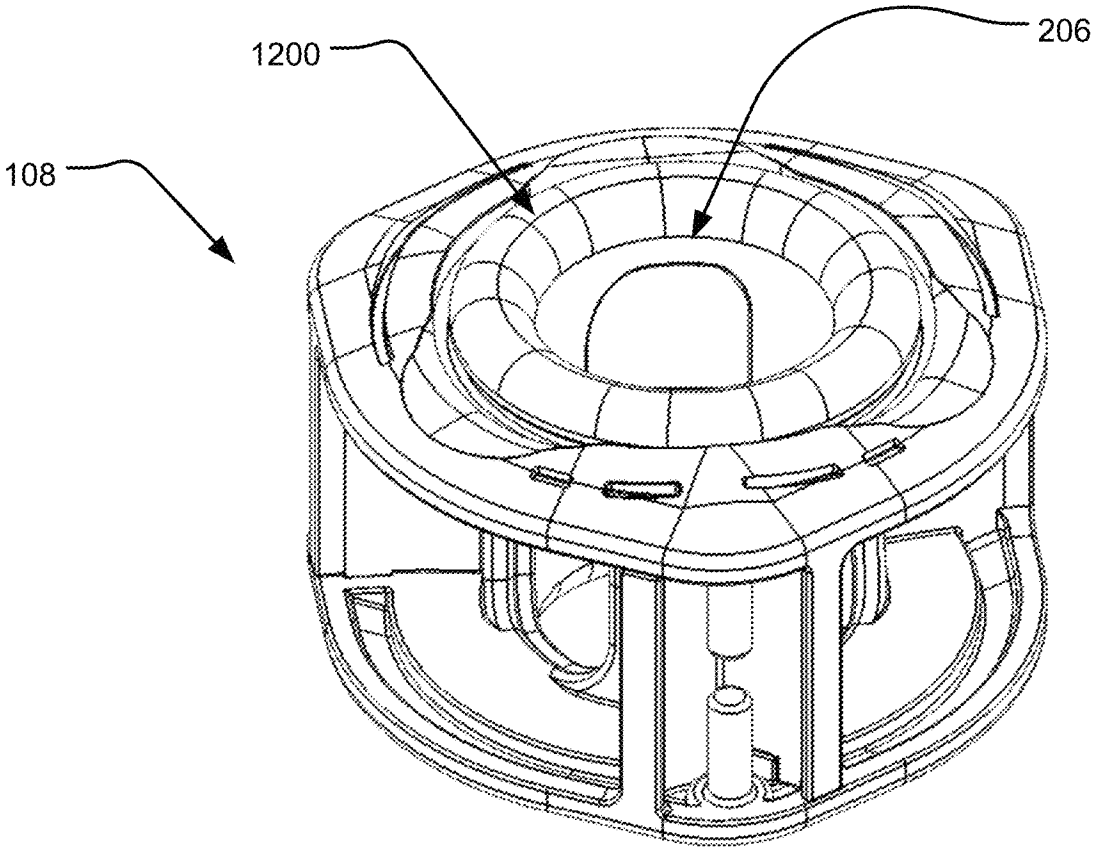
FIG. 13 is an isometric view of the liner coupled to a completed shell.

FIG. 13 is an isometric view of the liner 1200 installed on the shell housing 108. The liner may be installed on a shell housing 108 or device 100. Due to the flexibility of the liner 1200, the liner 1200 can be folded or squeezed into position within the shell opening 206. When in place, the channel groove 1210 contacts and wraps around the shell opening lip 210. The liner 1200 provides an additional stimulus via its material texture and shape. The liner 1200 may provide a disruptive surface to the shell housing 108 by creating an edge near the center opening 206. Furthermore, the liner 1200 may be a different material than the shell 102, creating a touch sensation of differing surfaces and textures. After the device 100 is completely assembled, with or without a liner 1200, releasable inserts 104 of various feedback surfaces 700 and releasable corners 106 of various feedback outer surfaces 1006 can be mixed, changed, and customized by a user. It will be appreciated that the feedback surfaces 700 and the feedback outer surfaces 1006 are not limited to the variations that will be discussed next. Furthermore, feedback surfaces 700 and feedback outer surfaces 1006 that contain different visual, audio, and temperature stimulants are contemplated.

Figure 14A:
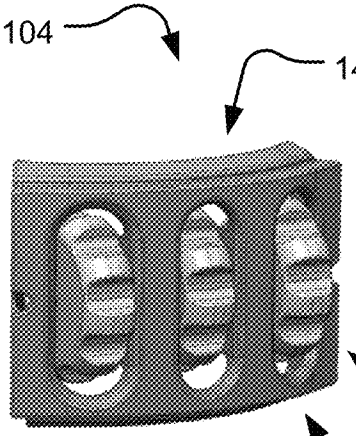
FIGS. 14A-F illustrate example feedback surfaces of the releasable inserts including wheels, soft dots, a rocker switch, a joystick, a pair of joysticks, and an infinity track, respectively.
Figure 14B:
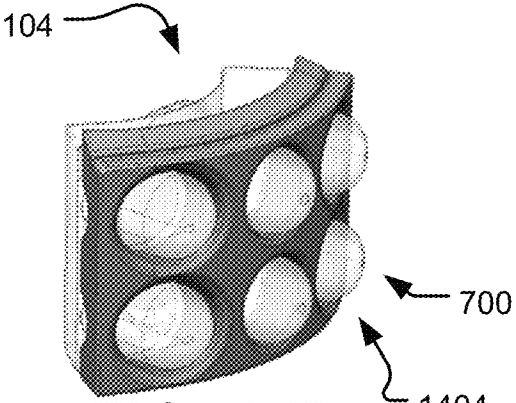
Figure 14C:
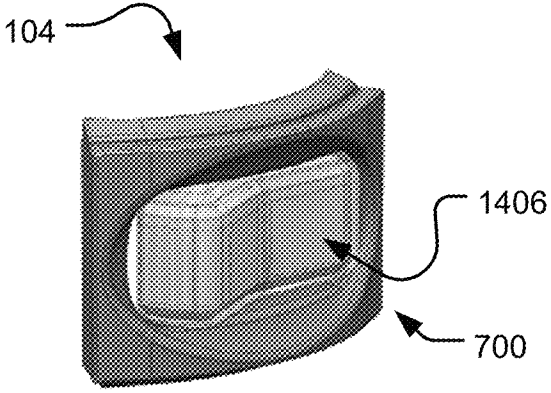

FIGS. 14A-F are example feedback surfaces 700 of the releasable inserts 104 including wheels 1402, soft dots 1404, a rocker switch 1406, a joystick 1408, a pair of joysticks 1412, and an infinity track 1416, respectively. In FIG. 14A, a plurality of wheels 1402 are housed in the insert shell 1400. The wheels 1402 freely spin on a rod and provide a stimulus of spinning several wheels with a thumb or finger. The wheels 1402 may also provide additional stimulus; for example, the edge of the wheels 1402 may have ridges or may be smooth. In FIG. 14B, a plurality of soft dots 1404 are made of a soft, flexible material such as silicon, rubber, or the like. The soft dots 1404 allow a user to push the dots inward towards the center of the device 100. The rocker switch 1406, shown in FIG. 14C, pivots on a vertically placed rod within the frame of the releasable insert 104. The rocker switch 1406 allows a user to push the switch 1406 on either end. When one end is pushed inward, the opposite end is pushed outwards, thus simulating activating an on-off switch.

Figure 14D:
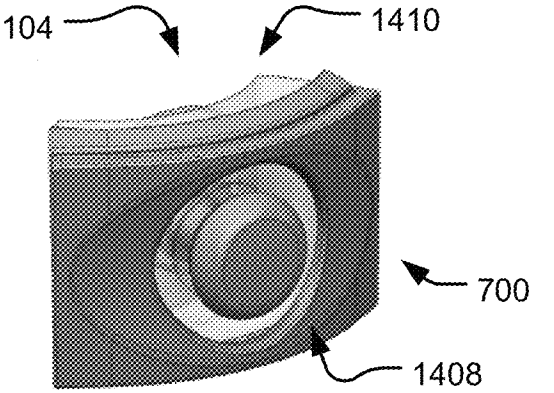
Figure 14E:
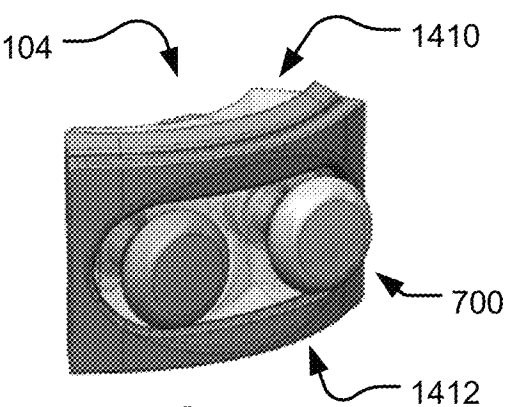
Figure 14F:
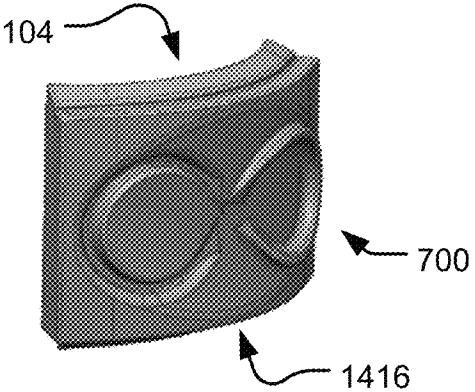

In FIG. 14D, the joystick 1408 is held within a soft, flexible base 1410 and allows a user to pivot the joystick within a circular plane. FIG. 14E is essentially the same implementation as FIG. 14D except there are two joysticks 1412 housed within a soft, flexible base 1410. An infinity track 1416 is shown in FIG. 14F where one half of the infinity track 1416 is raised from the surface and the other half is etched into the surface. A user can trace the infinity track 1416 and receive different touch sensations based on the different surface levels and textures.

Figure 15A:
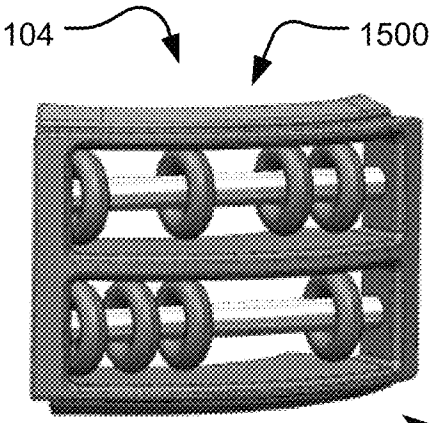
FIGS. 15A-E show additional example feedback surfaces of the releasable inserts including an abacas, soft shapes, soft oval, affront view of an insert featuring a soft button, and a rear view of the same insert featuring a soft logo, respectively.
Figure 15B:
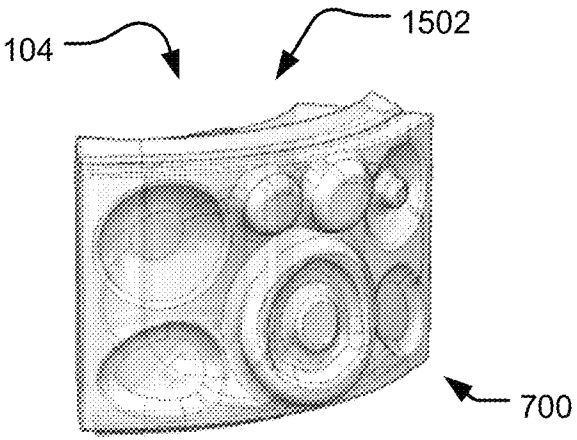

FIGS. 15A-E are additional example feedback surfaces 700 of the releasable inserts 104 including an abacas 1500, flexible shapes 1502, flexible oval 1504, and a front view of a flexible surface including a soft button 1506 and a rear view of the flexible surface featuring a logo 1508, respectively. The abacas 1500, shown in FIG. 15A, includes a plurality of rings on two bars that can move freely along the axis of the bars. A user can move one or more rings forward and backwards. In FIGS. 15B-E, the insert 104 is made of a soft, flexible material such as silicon, rubber, or the like, to create a soft, pressable surface. Different shapes or designs can be manufactured into the surface of the insert 104 via injection molding or other manufacturing methods. In FIG. 15B, the soft shapes surface 1502 consists of circular like shapes in different diameters and elevations; some are raised while others are depressed into the surface.

Figure 15C:
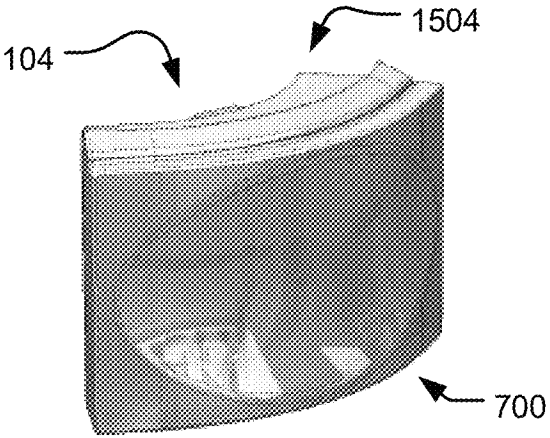
Figure 15D:
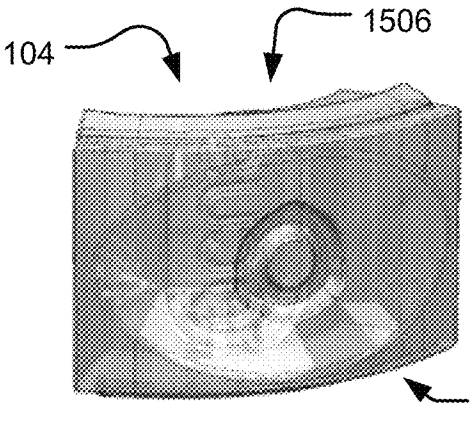
Figure 15E:
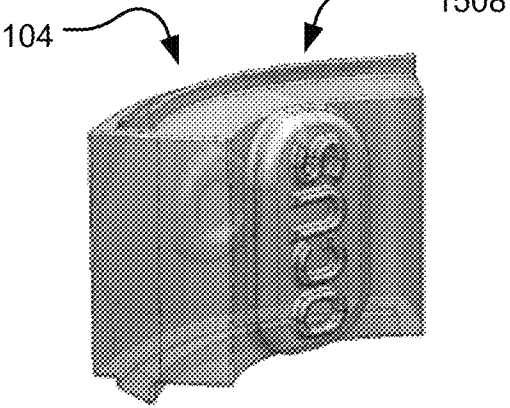

In FIG. 15C, the surface 700 consists of a plain oval 1504, which may contain other designs, as shown in FIGS. 15D-E. FIG. 15D shows a front view of the insert 104 featuring a button 1506 within an oval. The rear portion of the insert 104, shown in FIG. 15E, includes an outline of a logo 1508. The insert of 15D and 15E provides a different stimulus by having a raised or depressed design on both the front and rear of the insert 104. A user can trace or lightly press the button 1506 for one type of stimulus and then press hard enough to contact the logo 1508 on the rear portion of the insert for a different type of stimulus. Furthermore, the logo 1508 or rear portion of the insert 104 can also be reached via the insert backing opening 226 for another type of stimulus.

Figure 16B:
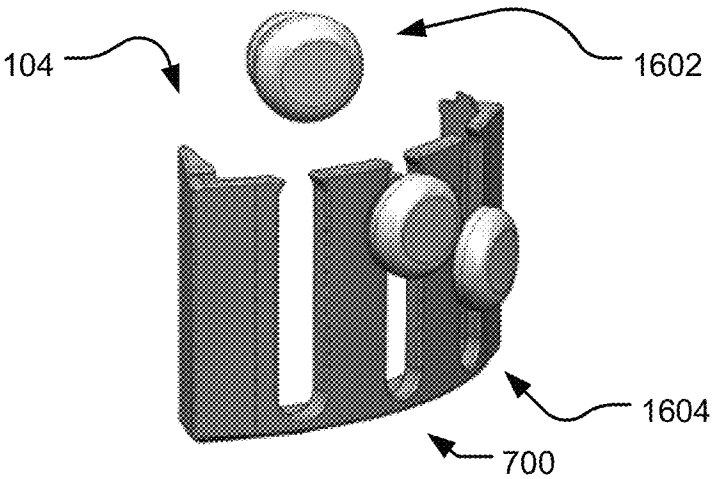
FIGS. 16A-C depict example feedback surfaces involving slide buttons on tracks including two horizontal tracks, three vertical tracks, and a twist track, respectively.
Figure 16C:
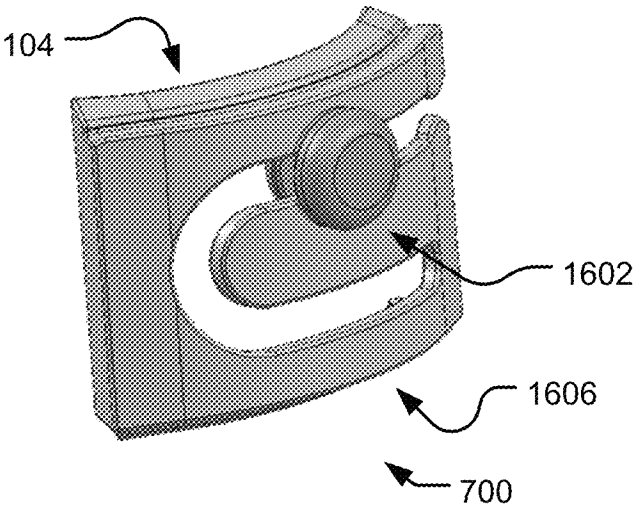
Figure 16A:
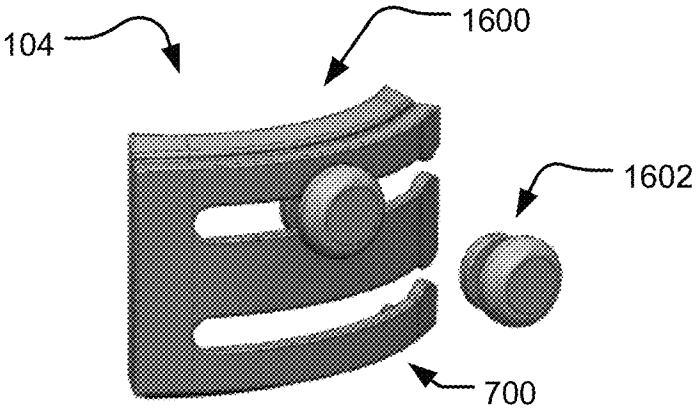

FIGS. 16A-C are example feedback surfaces involving slide buttons 1602 on tracks including two horizontal tracks 1600, three vertical tracks 1604, and a twist track 1606, respectively. The buttons 1602 are free to move within the path of the given track and a user can move one or more buttons 1602 along each path. The buttons 1602 may also be any shape including, but not limited to, circular, oval, rectangular, star shaped, or square shaped, or the like. Each track provides a different stimulus. For example, a user would typically move the buttons 1602 on the horizontal tracks 1600 by swiping their thumb or finger left to right whereas a user would typically move the buttons 1602 on the vertical tracks 1602 by moving their thumb or finger up and down. Furthermore, the twist track 1606 provides a hybrid of both motions and incorporates moving the button 1602 both in the horizontal and vertical directions.

Figure 17C:
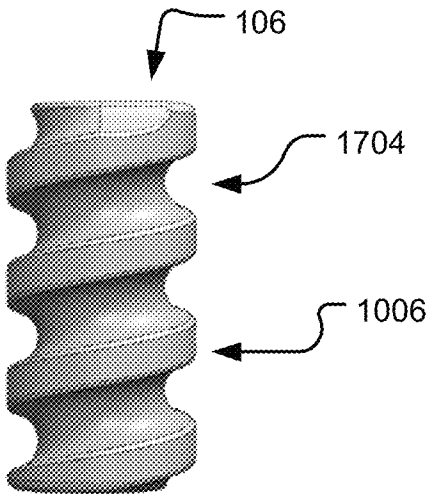
FIGS. 17A-G show example corners involving circular protrusions, circular indents, a swirl, three twisted vertical ridges, three vertical ridges, five twisted vertical ridges, and five vertical ridges, respectively.
Figure 17B:
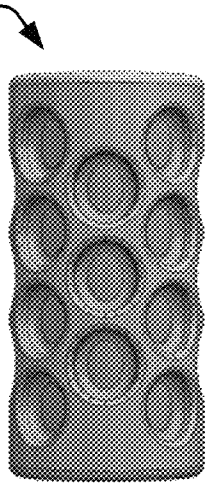
Figure 17A:
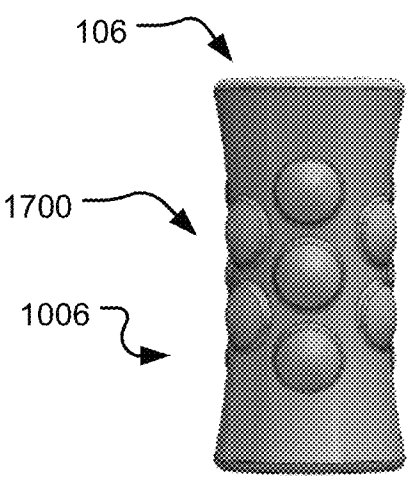
Figure 17G:
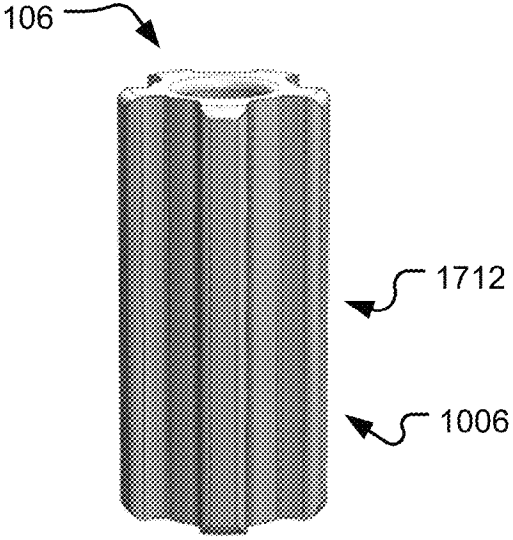
Figure 17F:
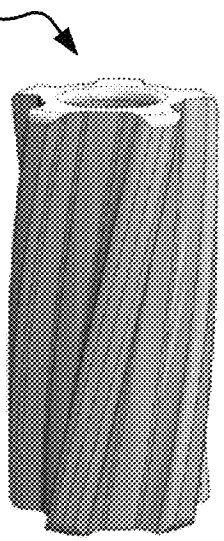
Figure 17E:
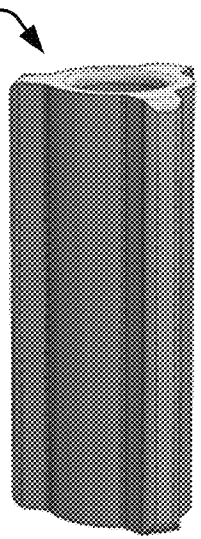
Figure 17D:
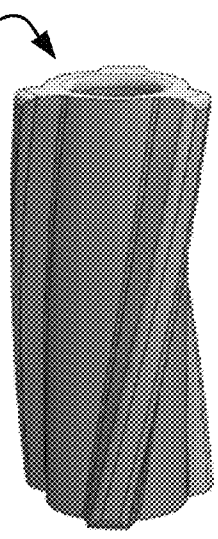

FIGS. 17A-G are example releasable corners 106 with different feedback outer surfaces 1006 involving circular protrusions 1700, circular indents 1702, a swirl 1704, three twisted vertical ridges 1706, three vertical ridges 1708, five twisted vertical ridges 1710, and five vertical ridges 1712, respectively. As previously discussed, the releasable corners 106 are allowed to freely spin on two corner posts 240, providing a stimulus in itself. Additionally, the releasable corner 106 may provide another stimulus based on the design of the corner feedback outer surface 1006. A user can touch or spin the releasable corner using the particular feature on the feedback outer surface 1006. In FIG. 17A the corner 106 is generally hourglass shaped and includes a plurality of raised bumps 1700 surrounding the middle of the corner 106. The releasable insert 106 in FIG. 17B includes a plurality of depressed bumps 1702 along most of the feedback outer surface 1000. FIG. 17C shows an releasable insert 106 with a swirl design 1704 extending along the entire length of the insert 106. FIG. 17D includes three twist ridges 1706 slightly twisted around the center axis of the releasable insert 106. FIG. 17E includes three ridges 1706 that extend from one end of the releasable insert 106 to the other and are positioned equidistance around the releasable insert 106. FIGS. 15F and 15G are similar to FIGS. 15D and 15E, respectively, except instead of three ridges, there are five ridges.

Figure 18B:
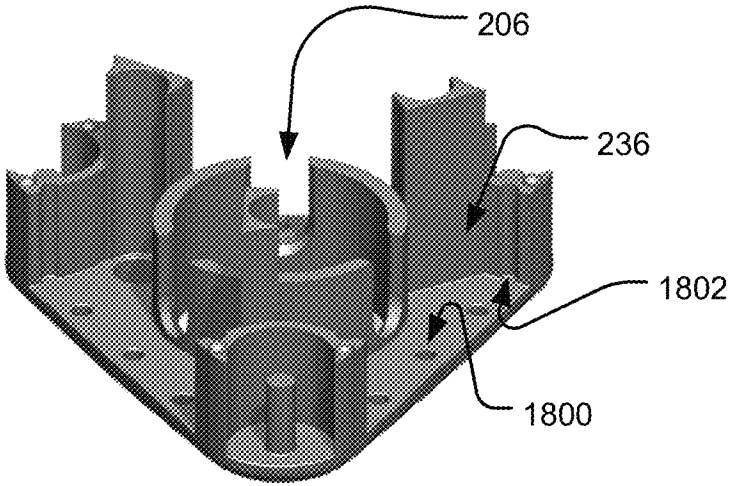
FIGS. 18A-C are an isometric first and second view of an second implementation shell and an isometric view of two shells aligned for coupling, respectively.
Figure 18C:
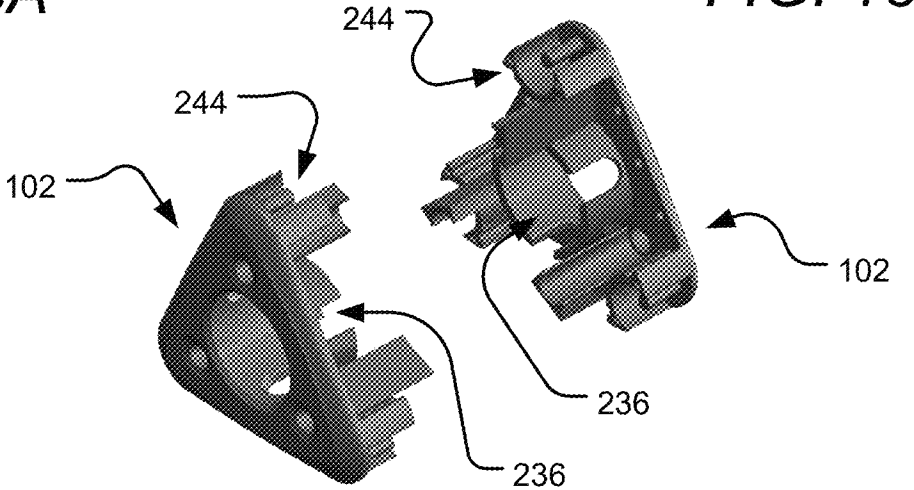
Figure 18A:
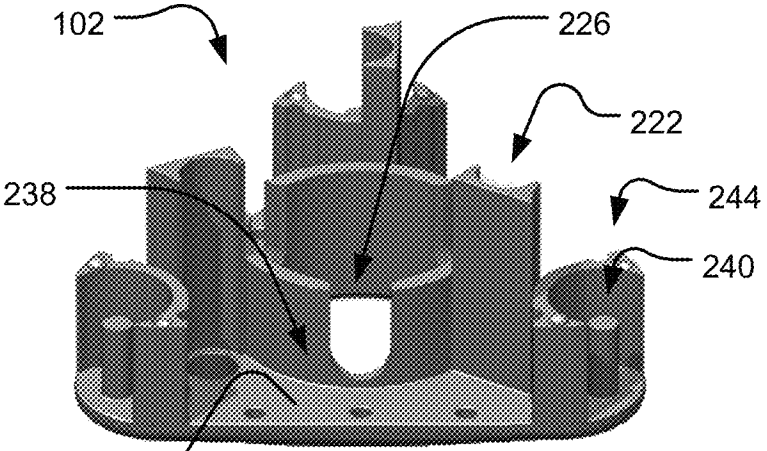

FIGS. 18A-C are an isometric first and second view of a second implementation of the shell 102 and an isometric view two shells 102 aligned for coupling, respectively. The shell 102 is triangular with a center opening 206. The shell 102 similarly includes a plurality of protrusions 222 extending from an inner surface 202 and each protrusion 222 positioned near a rounded edge 220. The protrusions 222 partially define an insert area 236 having an insert receiver 238. In an example implementation, the insert receiver 238 is both three receiver holes 1800 configured to receive roller inserts 1900, shown in FIGS. 19A and C, and an insert receiver groove 1802 positioned on the protrusion 222 and configured to receive releasable inserts 104. The shell 102 also has an insert backing opening 226 to provide access to the rear portion of a releasable insert 104. A corner area 244 is positioned at each rounded edge 220 having a post 240 configured to receive and hold a releasable corner 106. The shells 102 do not have any fasteners nor do they need any adhesion to lock together. FIG. 18C shows the shells 102 aligned for coupling where each insert area 236 and corner area 244 on one shell 102 are aligned with a corresponding insert area 236 and corner area 244 on the other shell 102. After various releasable inserts 104, roller inserts 1900, and releasable corners 106 are selected for installation, the device 100 is ready to be assembled.

Figure 19B:
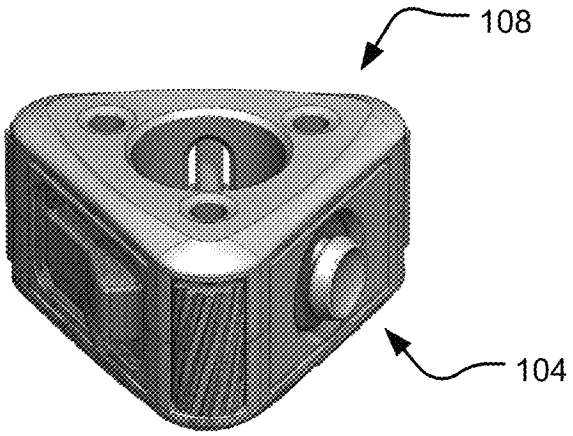
FIGS. 19A-C are, respectively, an isometric view of the two shells with a plurality of roller inserts aligned for coupling, an isometric view of releasable inserts and corners housed in a completed shell, and an isometric view of two roller inserts housed in the completed shell.
Figure 19C:
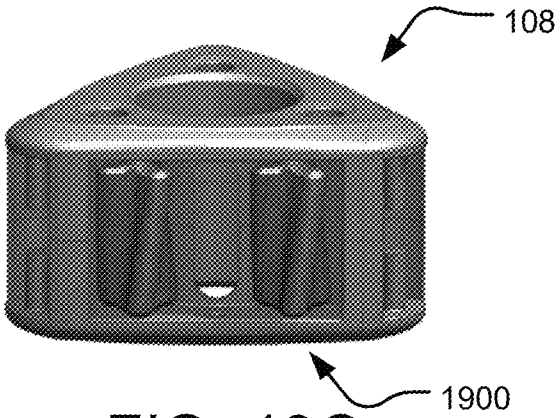
Figure 19A:
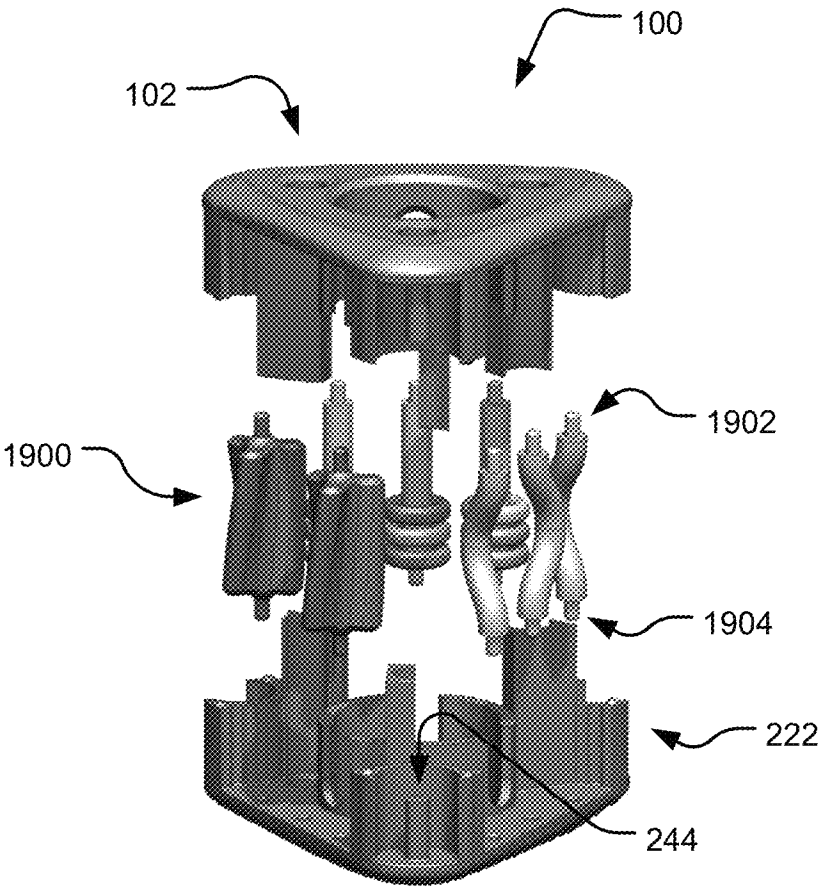

FIGS. 19A-C are, respectively, an isometric view of two shells 102 with a plurality of roller inserts 1900 aligned for coupling, an isometric view of releasable inserts 104 and corners 106 housed in a shell housing 108, and an isometric view of two roller inserts 1900 housed in the shell housing 108. The roller inserts 1900 are elongated members with two posts on each end. In a shell housing 108, a first post 1902 is received by one of the three receiver holes 1800 in one shell 102 and a second post 1904 is received by a corresponding receiver hole 1800 in a second shell 102. The roller insert 1900 is allowed to freely rotate once it is housed in the shell housing 108 as the posts can spin within the receiver hole 1800. The posts also prevent the roller insert 1900 from falling out of the shell housing 108. Once the device 100 is assembled, the device 100 provides multiple surfaces and types of feedback to a user. Various types of feedback are contemplated beyond the implementations that will be discussed next.

Figure 20B:
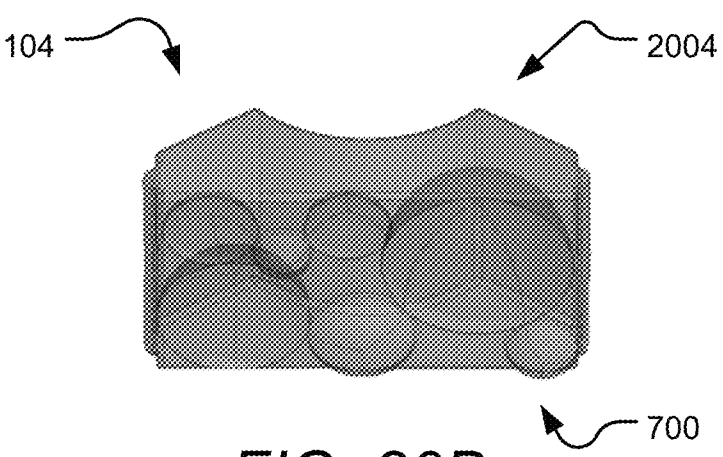
FIGS. 20A-D depict example feedback surfaces of releasable inserts for use with the alternative shells including soft buttons, soft shapes, plastic shapes, and two joysticks, respectively.
Figure 20A:
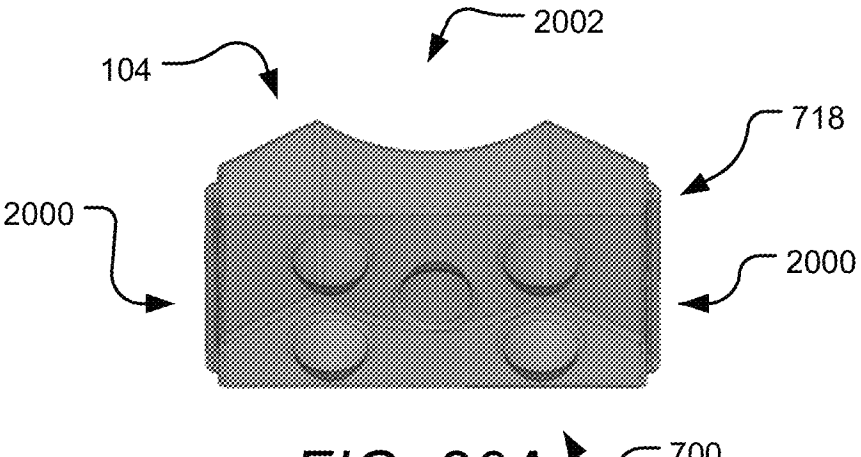
Figure 20D:
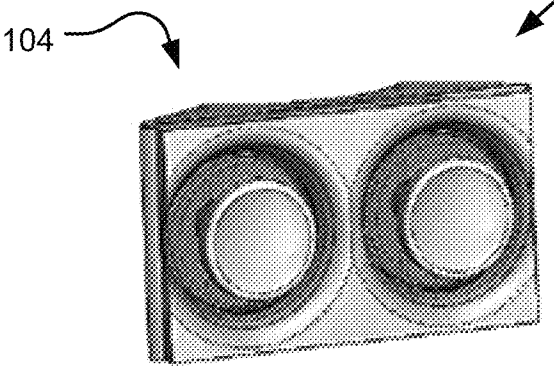
Figure 20C:
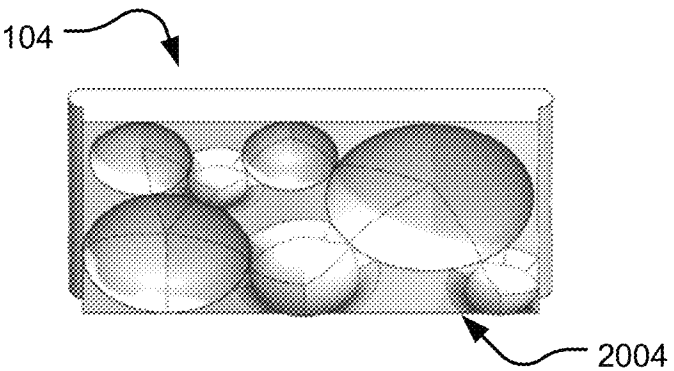

FIGS. 20A-D are example feedback surfaces 700 of releasable inserts 104 for use with the second implementation shells 102 including soft buttons 2000, soft shapes 2002, plastic shapes 2004, buttons 1602 with two tracks 2006, respectively. Generally, the releasable inserts 104 include a coupler 718. In an example implementation, the coupler 718 is a ridge 2000 on one end of the generally rectangular shaped insert 104 and the same ridge 2000 on the opposite side of the releasable insert 104. The two ridges 2000 are received into the insert receiver grooves 1802, shown in FIG. 18B, when housed in the shell housing 108. FIGS. 20A-B are example releasable inserts that are made of silicon, rubber, or other similar material with different designs on the feedback surface 700. FIG. 20A features four raised buttons surrounding a center depressed button while FIG. 20B features a plurality of circular designs of different diameters, heights, and depths. FIG. 20C features the same plurality of circular designs 2004 found in FIG. 20B except that the insert 104 is made of a solid material such as plastic, aluminum, or the likes. FIG. 20D shows an insert 104 with two joysticks 2006. The two solid joysticks 2006 are coupled to a backing and surrounded by a flexible base to both hold the joysticks 2006 in place and to provide a feedback resistance when moving the joysticks 2006.

Figure 21B:
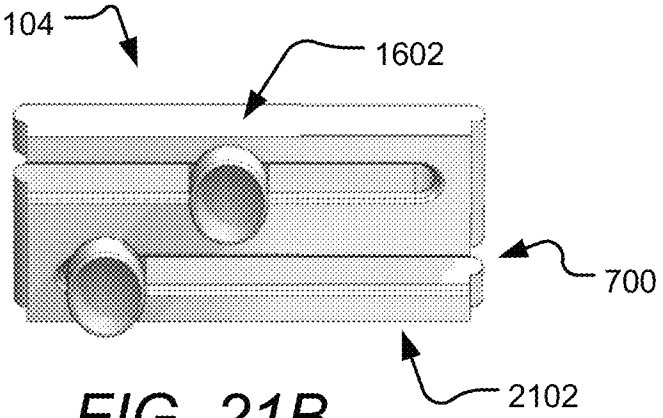
FIGS. 21A-C illustrate additional example feedback surfaces of releasable inserts for use with the alternative shells featuring buttons on different track designs including three vertical tracks, two horizontal tracks, and a zigzag track, respectively.
Figure 21A:
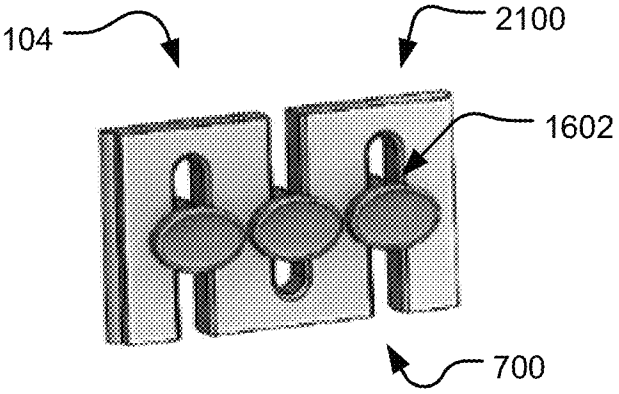
Figure 21C:
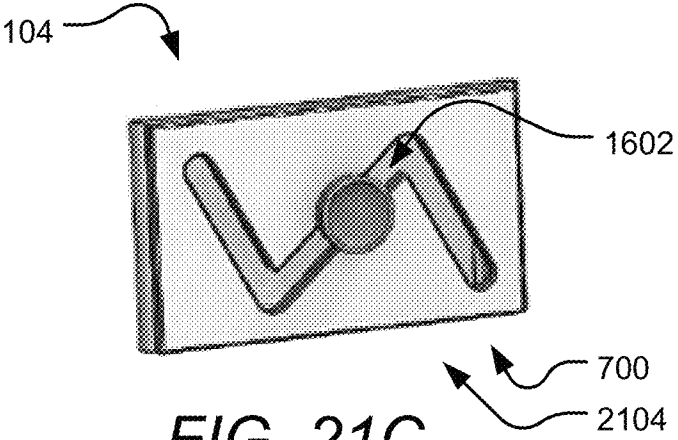

FIGS. 21A-C are more example feedback surfaces 700 of releasable inserts 104 for use with the alternative shells 102 featuring buttons 1602 on different track designs including three vertical tracks 2100, two horizontal tracks 2102, and a zigzag track 2104, respectively. Three tracks 2100 with three buttons 1602 are shown in FIG. 21A. The two outer vertical tracks 2100 are identical while the middle track 2100 is a flipped image of the two outer tracks 2100. In FIG. 21B, the two horizontal tracks 2008 extend through a majority of the insert 104 and are mirror and flipped images of each other. FIG. 21C also includes a button 1602 on a zigzag track 2104.

Figure 22A:
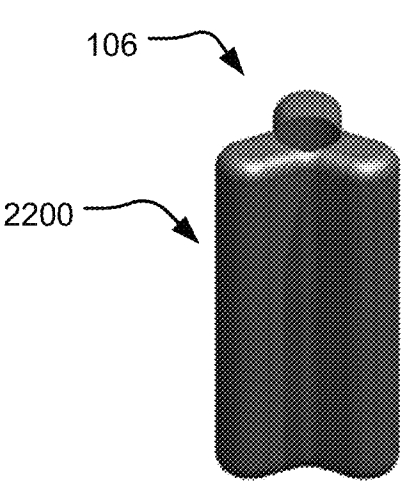
FIGS. 22A-B show example roller inserts for use with the alternative shells including a three ridge corner and a gear shaped corner, respectively.
Figure 22B:
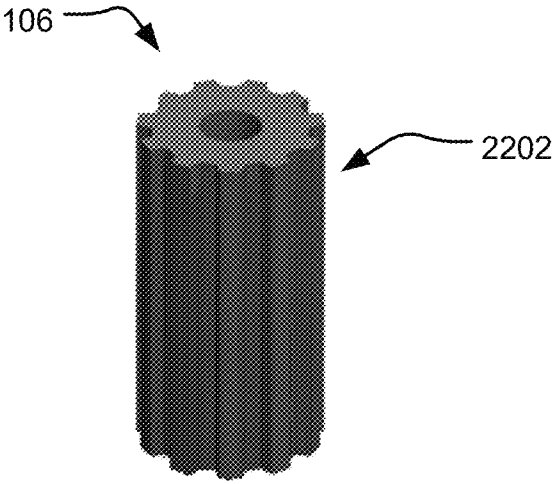

FIGS. 22A-B are example corners 106 for use with the second implementation shells 102 including a three ridge corner 2200 and a gear shaped corner 2202, respectively. Both example implementations feature a cross sectional design that extends the entire length of the corner 106. FIG. 22A shows an insert with a cross section made of three protrusions spaced equidistantly around an axis which, when extruded down the entire length of the corner 106, creates three ridges 2200. FIG. 22B is similar except the cross section is gear shaped 2202.

Figure 22C:
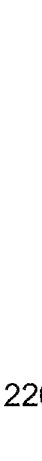
FIGS. 22C-E show example corners including rings, twist, and twisted three ridges, respectively.
Figure 22D:
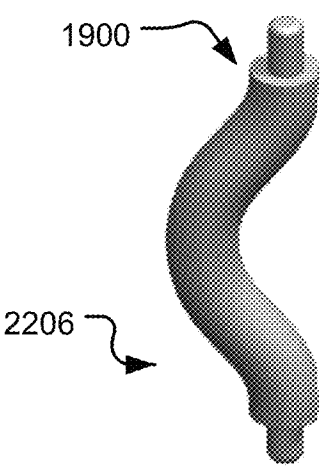
Figure 22E:
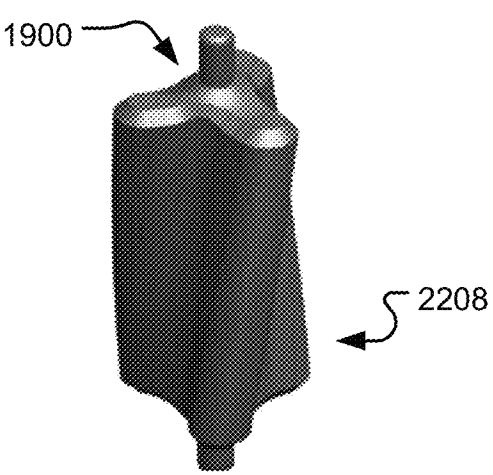

FIGS. 22C-E illustrate example roller inserts 1900 for use with the alternative shells 102 including rings 2204, a swirl post 2206, and a three ridge twist 2208, respectively. Similarly to the corners 106, the roller inserts 1900 provide feedback to a user by allowing the user to freely spin the roller insert 1900. Additionally, the shape and design of the roller insert 1900 provides an additional feedback. FIG. 22C shows a roller insert 1900 with rings 2204 that can move laterally and spin on the bar shaped roller insert 1900. In FIG. 22D, the roller insert 1900 is also generally bar shaped, but includes a bend near the center of the roller insert 1900. FIG. 22E illustrates a roller insert 1900 with a cross sectional shape made of three protrusions 2208 spaced equidistantly around an axis and twisted as it was extruded down the length of the insert 1900.

Figure 23A:
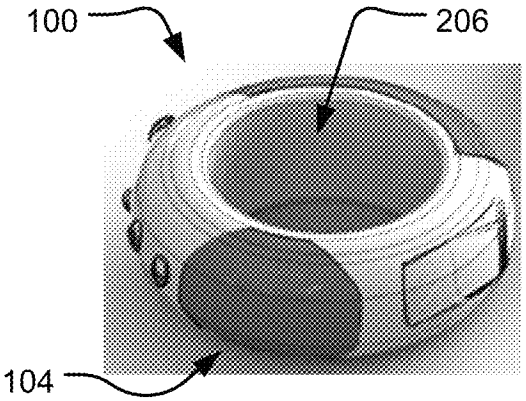
FIGS. 23A-C are isometric views of a first, second, and third implementation of the device with releasable inserts.
Figure 23B:
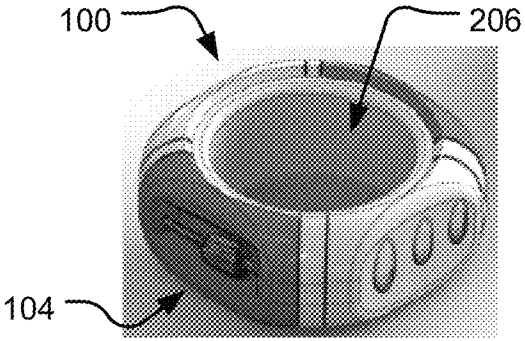
Figure 23C:
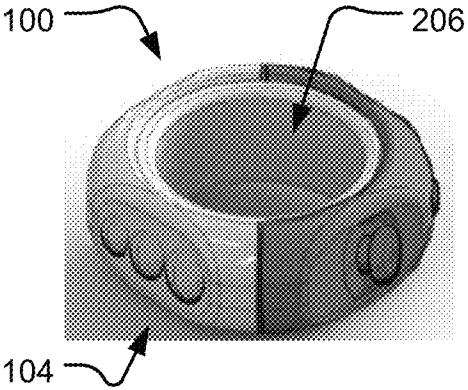
Figure 23D:
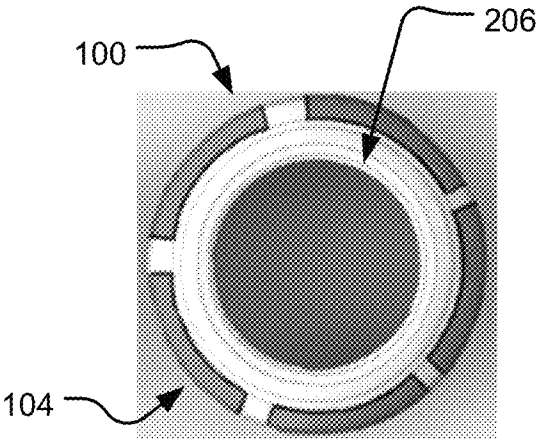
Figure 23E:
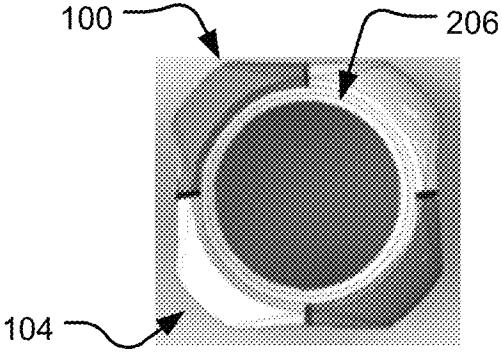
Figure 23F:
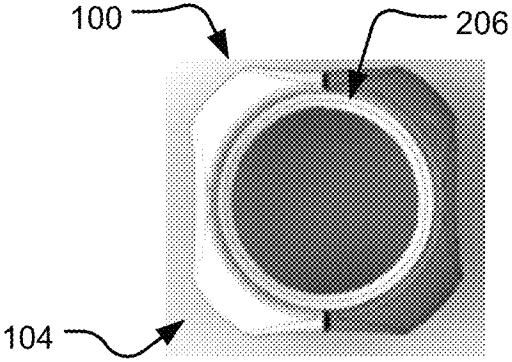

FIGS. 23A-C are an isometric view of another implementation of the device 100 with releasable inserts 104. In one implementation, shown in FIG. 23A, the device 100 is ring shaped with an opening 206. Four releasable inserts 104 are housed on the outer rounded portion of the shell 102. In another implementation, shown in FIG. 23B, the device 100 is square shaped with generally rounded corners and edges and an opening 206. The device 100 has four releasable inserts 104 along each straight edge of the generally square shaped device. The device 100 in FIG. 23C is generally the same as the device 100 in FIG. 23B, except that the device 100 has two releasable inserts 104, each encompassing one half of the device 100. FIGS. 23D-F is a top view of a circular device 100, a first square device 100, and a second square device 100, respectively. In FIG. 23D, the device 100 has five releasable inserts 104 housed equidistantly around the outer surface of the device 100. In FIG. 23E, the device 100 has four releasable inserts 104 on each corner of the device 100. In FIG. 23F, the device 100 has two releasable inserts 104, each insert 104 taking up half of the device 100.

Figure 24A:
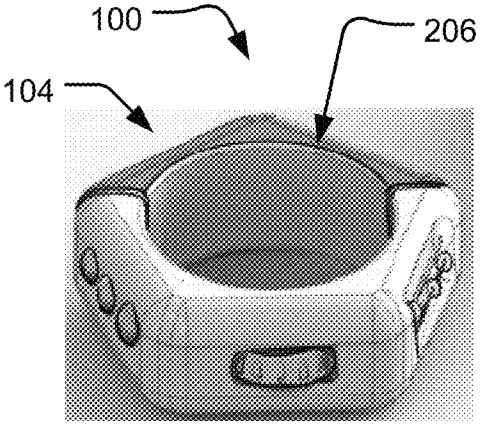
FIGS. 24A-C are isometric views of additional example implementations of the device with releasable inserts including a first, second, and third star shaped ring device, respectively
Figure 24B:
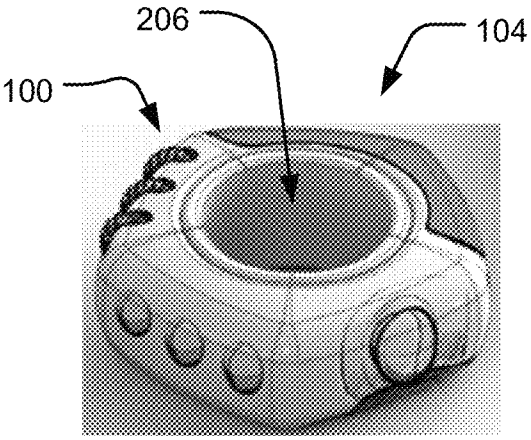
Figure 24C:
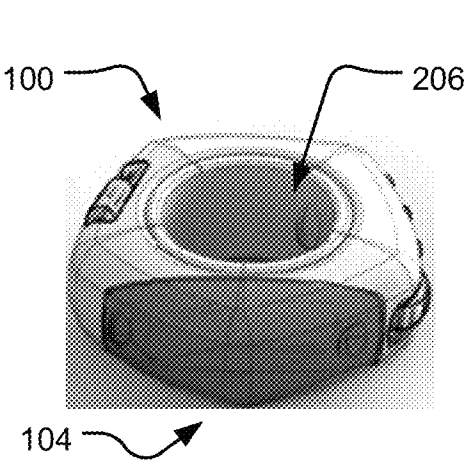
Figure 24D:
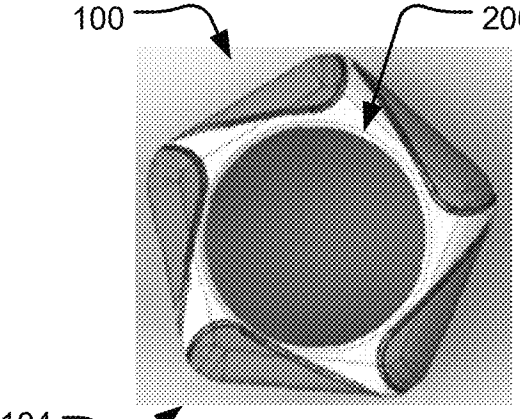
FIGS. 24D-F are top views of a fourth, fifth, and sixth star shaped ring device, respectively.
Figure 24E:
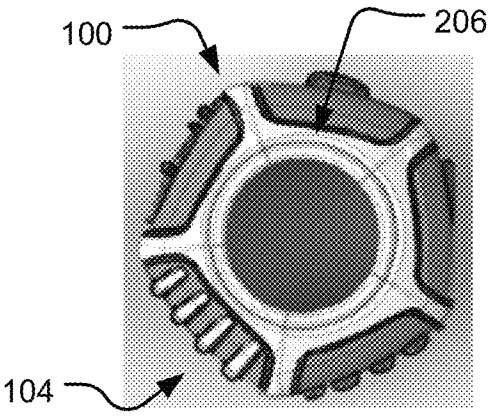
Figure 24F:
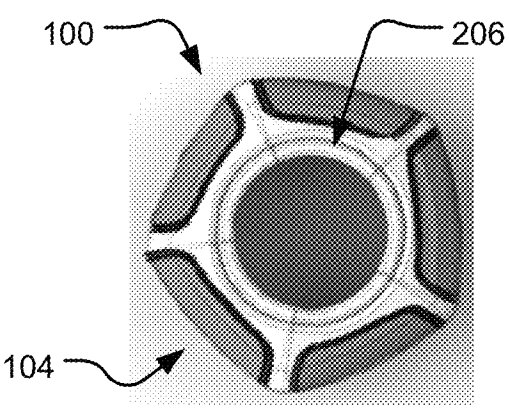

FIGS. 24A-C are an isometric view of additional example implementations of the device 100 with releasable inserts 104 including a first, second, and third star shaped ring device 100, respectively and FIGS. 24D-C are a top view of a fourth, fifth, and sixth star shaped ring device 100, respectively. The devices 100 are generally star shaped with a center opening 206 and five releasable inserts 104. The opening 206 in FIG. 24B is smaller than the opening 206 in FIG. 24A and larger than the opening 206 in FIG. 24C. The multiple sizes of each opening 206 accommodate different hand sizes and types of releasable inserts 104, as shown in FIGS. 24D-F. The releasable insert 104 in FIG. 24D generally covers the edges of the star shaped shell 102 and become thinner moving down the feedback surface. In FIGS. 24E and F the inserts 104 are generally uniformly shaped rectangles that fit within the sides of the shell 102.

Figure 25A:
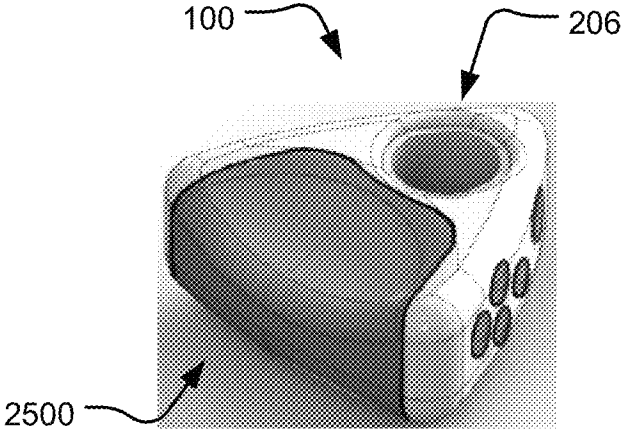
FIGS. 25A-D are isometric views of additional example implementations of the device with releasable inserts including a first, second, third, and fourth triangle shaped ring device, respectively.
Figure 25B:
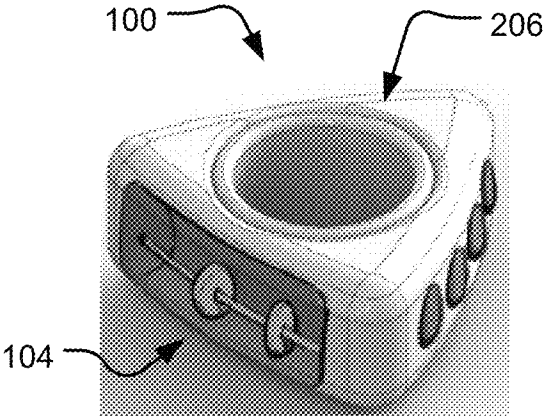
Figure 25C:
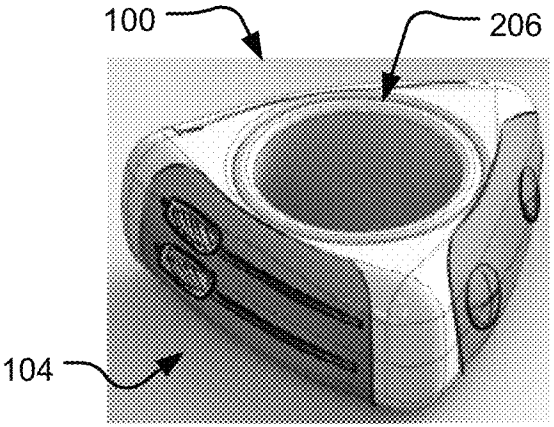
Figure 25D:
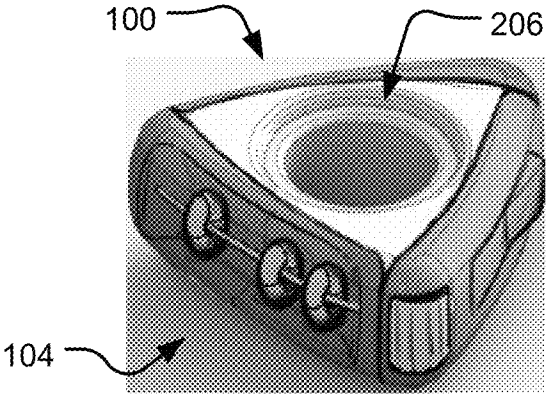

FIGS. 25A-D illustrate a first, second, third, and fourth implementation, respectively, of a triangle shaped device 100 with various releasable inserts 104 and openings 206. In FIG. 25A, the device 100 includes a small opening 206 near a corner of the device 100 and a flexible and soft pinch pad 2500. In FIG. 25B, the device 100 includes an opening 206 extending near the edge of each side of the device 100 and three releasable inserts 104. In FIG. 25C, the device 100 also includes an opening 206 extending near the edge of each side of the device 100 with three feedback surfaces, of which two releasable inserts 104. The device 100 in FIG. 25D includes an opening 206 smaller than the ones found on the devices 100 in FIGS. 25B and C. The opening 206 accommodates releasable inserts 104 which occupy the entire surface of each side and corner of the device 100.

Figure 26A:
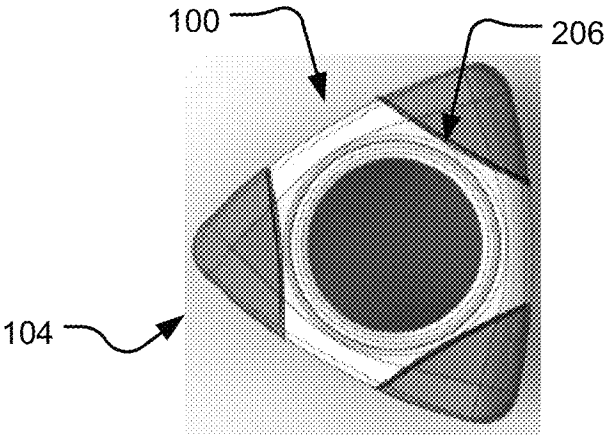
FIGS. 26A-D are top views of a first, second, third, and fourth triangle shaped devices with varying releasable inserts and circular openings.
Figure 26B:
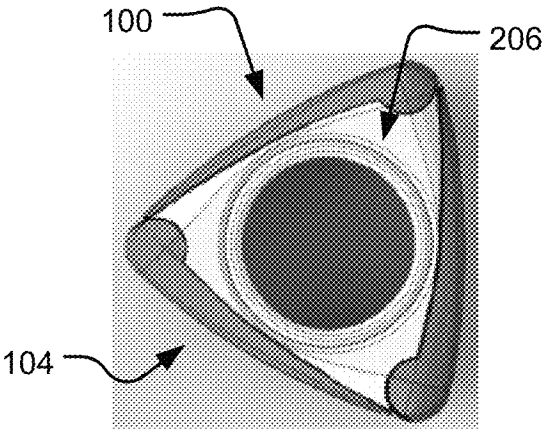
Figure 26C:
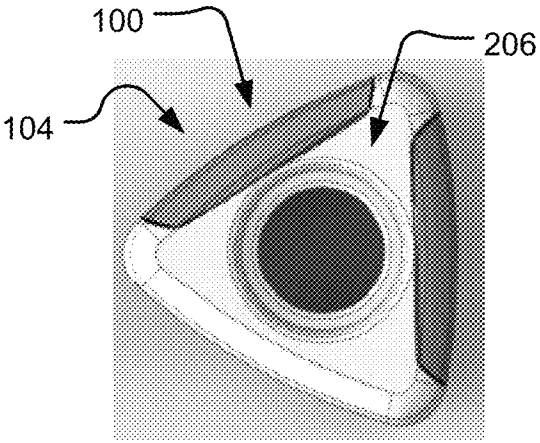
Figure 26D:
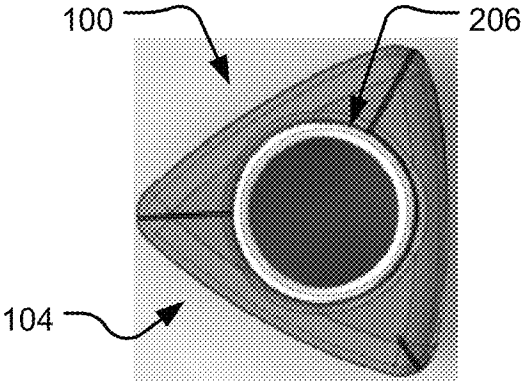

FIGS. 26A-D are a top view of additional triangle shaped devices 100 with varying releasable inserts 104 and circular openings 206. The releasable inserts 104 in FIG. 26A are three releasable corner inserts. In FIG. 26B, the three inserts 104 begins at each corner of the device and become thinner travelling on the edge of the device 100. In FIG. 26C, the device 100 has two inserts 104 on adjacent sides of the triangle, which stop short of the corners of the triangle. The device 100 in FIG. 26D include three inserts 104 which equally occupy the entire device 100 except for a cylindrical portion of the device 100 which defines the opening 206.

Figure 27A:
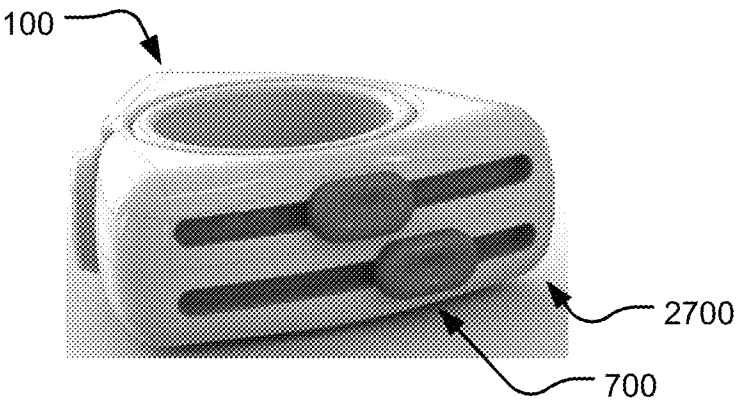
FIGS. 27A-D show example feedback surfaces and corners for use with a triangle shaped device including two sliders on two tracks, three wheels, a plurality of beads on a bar, and a corner wheel with ridges, respectively.
Figure 27B:
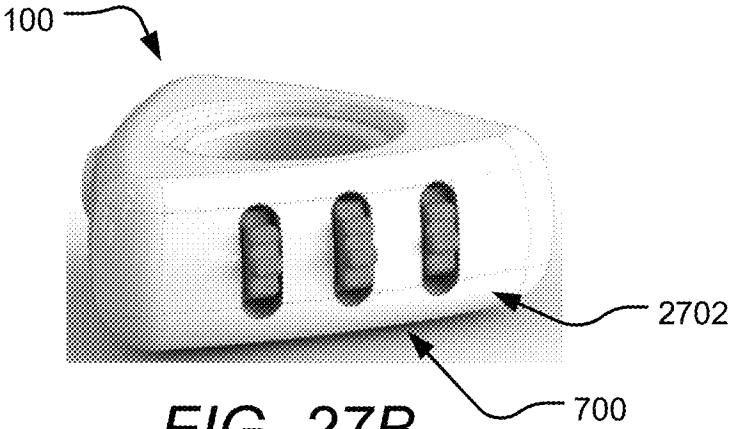
Figure 27C:
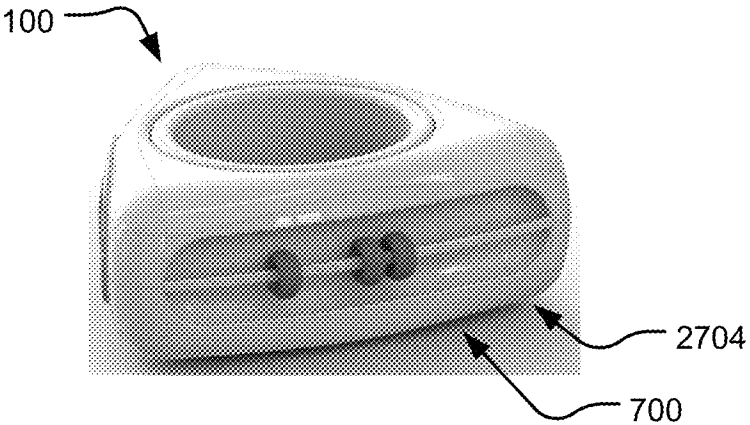
Figure 27D:
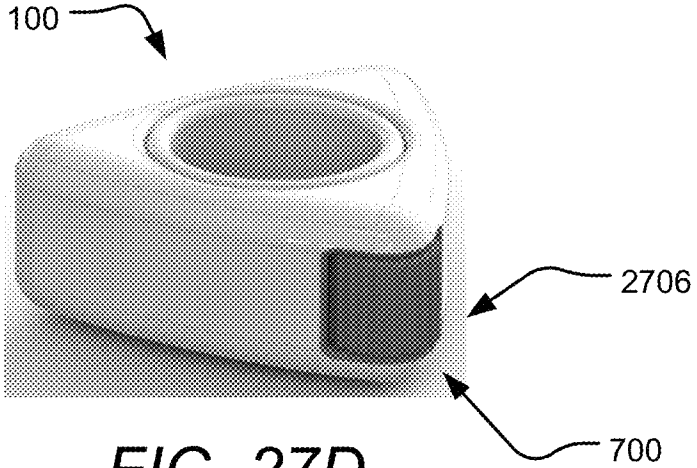

FIGS. 27A-D are example feedback surfaces 700 and corners 106 for use with a triangle shaped device 100. FIG. 27A shows a triangle device 100 with a feedback surface 700 made of two sliders on two tracks 2700 which extend along the entire side. The device 100 in FIG. 27B includes three wheels 2702 which a user can spin. The three wheels 2702 may have varying levels of resistance to provide a feedback different from free spinning wheels. FIG. 27C shows a plurality of beads 2704 on a bar parallel and centered in the side of the device 100. Lastly in FIG. 27D, a corner feedback is shown, including a wheel with ridges 2706.

Figure 28A:
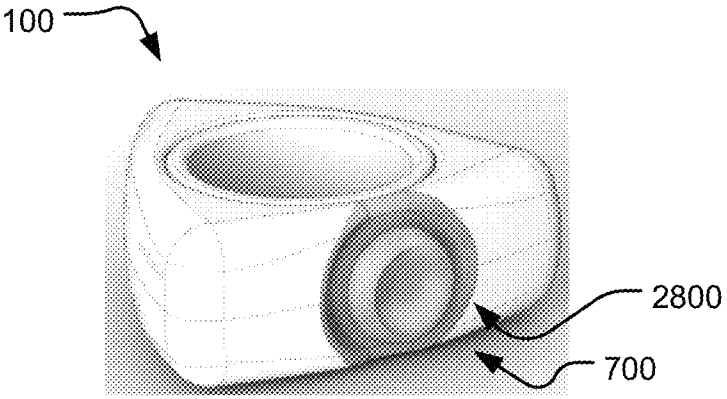
FIGS. 28A-D illustrate additional example feedback surfaces on the side of a triangle shaped device including a button, an infinity track, abstract lines, and a plurality of small raised bumps, respectively.
Figure 28B:
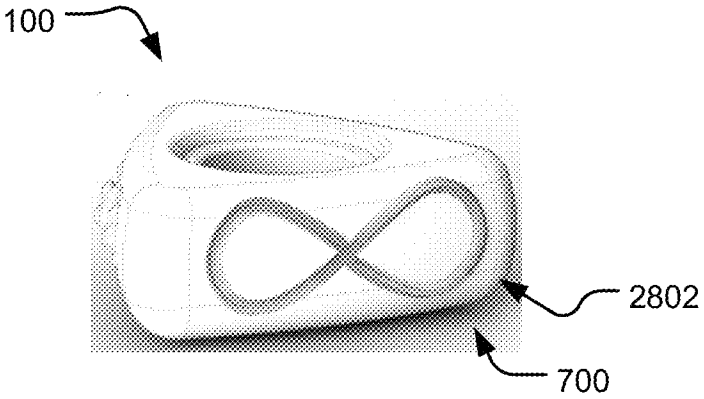
Figure 28C:
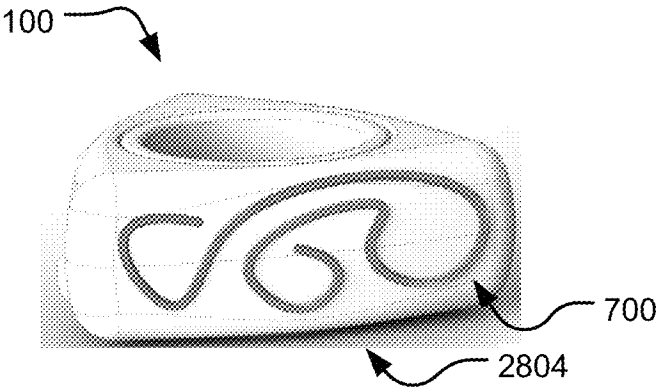
Figure 28D:
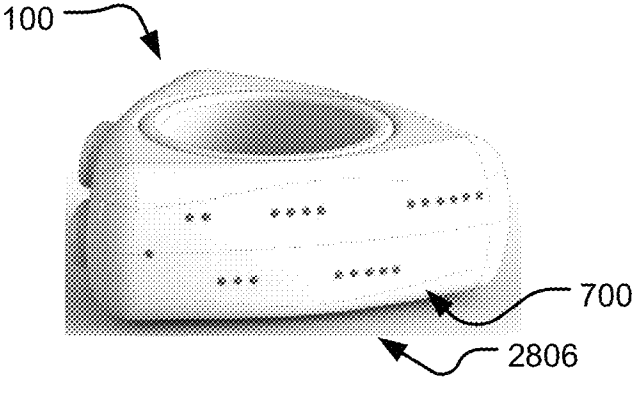

FIGS. 28A-D are additional example feedback surfaces 700 on the side of a triangle shaped device 100. In FIG. 28A, the feedback surface 700 is a button 2800 which can be depressed with a finger or thumb. In FIG. 28B, the feedback surface 700 is an infinity track 2802 with half of the track raised and the other half etched into the surface. A user can trace their finger or thumb over or on the track. FIG. 28C is similar to FIG. 28B except that the design is a raised continuous abstract line with randomized turns 2804. FIG. 28D are a set of small raised bumps 2806, which a user can also trace over with a finger or thumb.

Figure 29A:
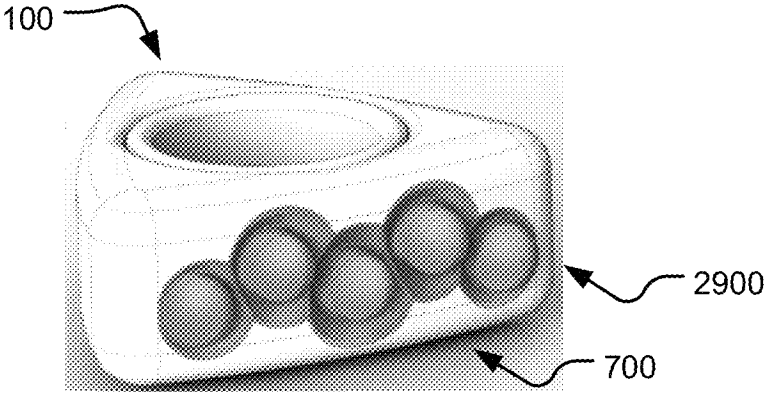
FIGS. 29A-D show additional example feedback surfaces for use with a triangle shaped device including raised buttons, indented buttons, a pinch pad, and a track, respectively.
Figure 29B:
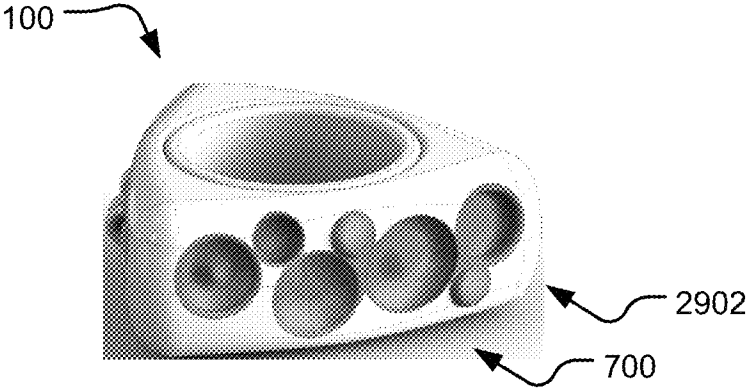
Figure 29C:
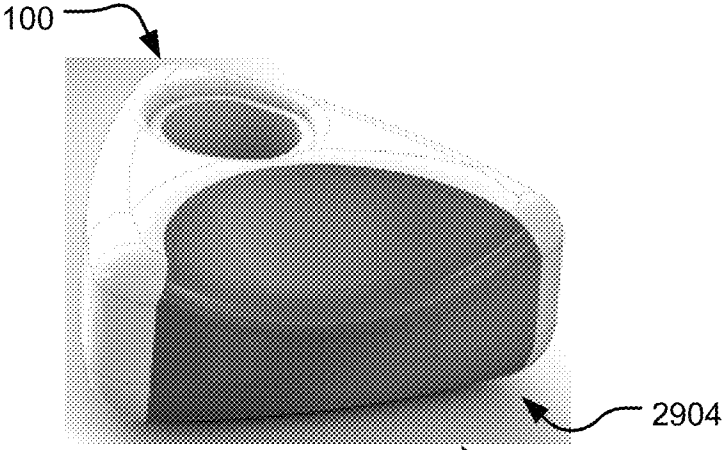
Figure 29D:
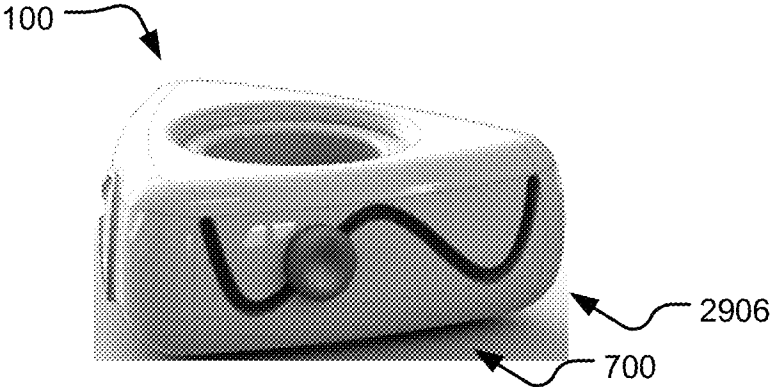

FIGS. 29A-D are also additional example feedback surface 700 for use with a triangle shaped device 100 including raised buttons 2900, indented buttons 2902, a pinch pad 2904, and a track 2906, respectively. The raised buttons 2900, shown in FIG. 29A, and the indented buttons 2902, shown in FIG. 29B, allow a user to trace their finger or thumb over the buttons. The buttons may be made from a soft flexible material such as silicon, rubber, or the like, and provide stimuli by being made of a different material than the shell. In FIG. 29C, the pinch pad 2904 occupies a large portion and carves into the top surface of the triangle device 100. The pinch pad 2904 has a curved surface and is thinner than the rest of the device 100, making it natural to hold the device with a thumb and a finger pinching the pinch pad. In FIG. 29D, a button is on a track with three bends 2906. A user can move the button along the track with a finger or thumb.

Figure 30B:
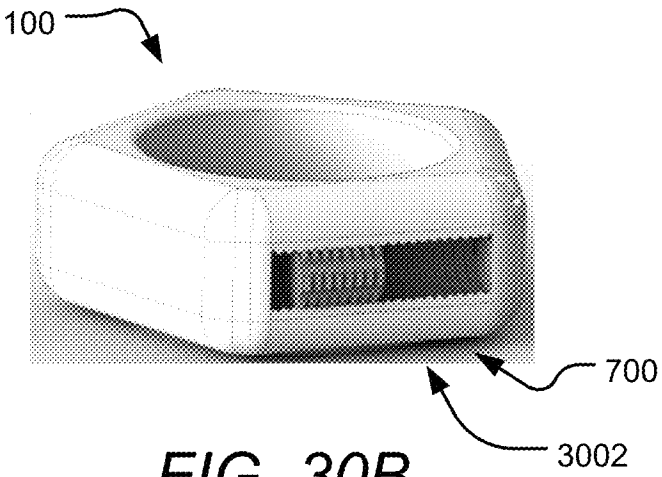
FIGS. 30A-B illustrate example feedback surfaces for use with a star shaped device including a rocker switch and an internal roller, respectively.
Figure 30A:
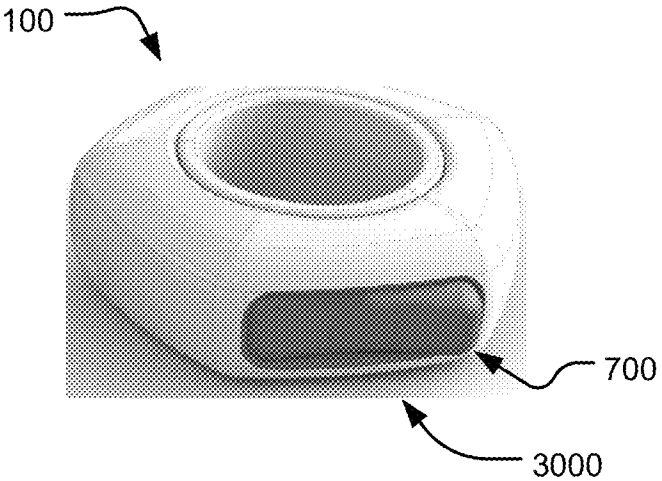

FIGS. 30A-B illustrate example feedback surface 700 for use with a star shaped device 100 including a rocker switch 3000 and an internal roller 3002, respectively. The rocker switch 3000, shown in FIG. 30A, may occupy one side of the device. When a user presses down on one side of the switch, the other side of the switch rises. In FIG. 30B, an internal roller 3002 is shown. The internal roller 3002 includes a cylindrical member with external threads housed in a half open hollow cylinder with internal threads. The cylindrical member partially protrudes out of the hollow cylinder and allows a user to turn the cylindrical member to move it up or down along the internal threads.

The description above includes example systems of the present disclosure. However, it is understood that the described disclosure may be practiced without these specific details.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

The invention claimed is:

1. A custom feedback device comprising:

a first shell having a first inner surface disposed opposite a first outer surface, the first inner surface including at least one of a ridge or a groove;

a first shell opening defined in the first shell and extending through the first shell;

a first plurality of protrusions extending from the first inner surface, the first plurality of protrusions including a first coupler;

a first plurality of receivers defined in the first inner surface;

a second shell having a second inner surface disposed opposite a second outer surface;

a second shell opening defined in the second shell and extending through the second shell;

a second plurality of protrusions extending from the second inner surface, each of the second plurality of protrusions including a second coupler;

a second plurality of receivers defined in the second inner surface, the first shell releasably engageable to the second shell to form a shell housing based upon a connection between the first plurality of protrusions with the second plurality of receivers and the second plurality of protrusions with the first plurality of receivers, with the first coupler of each of the first plurality of protrusions being releasably engageable to a respective second receiver of the second plurality of receivers and the second coupler of each of the second plurality of protrusions being releasably engageable to a respective first receiver of the first plurality of receivers, the connection:

forming a receiving area oriented around a side of the shell housing and defined between the first shell and the second shell; and aligning the first shell opening and the second shell opening to form an opening of space extending through a central axis of the shell housing; and a customized portion of a plurality of customized portions adapted to be housed at the receiving area based on a feature that mates with the at least one of the ridge or the groove of the first shell based on the feature having a shape complementary to the at least one of the ridge or the groove, wherein:

the customized portion is retained in the receiving area when the first shell and the second shell are engaged, and the customized portion is interchangeable with a second customized portion when the first shell and the second shell are disengaged, the first shell and the second shell being configured to disengage using a force that overcomes the connection.

2. The custom feedback device of claim 1, wherein the receiving area is an insert area and the customized portion is an insert.

3. The custom feedback device of claim 1, wherein the receiving area is a corner area and the customized portion is a corner.

4. The custom feedback device of claim 1, wherein the customized portion is interchangeable upon a release of the first shell from the second shell.

5. The custom feedback device of claim 1, wherein the customized portion is removable upon a release of the first shell from the second shell.

6. The custom feedback device of claim 1, wherein the customized portion is accessible when housed at the receiving area.

7. The custom feedback device of claim 1, wherein a liner is disposed within the opening.

8. The custom feedback device of claim 1, wherein the connection is a snap-fit connection.

9. The custom feedback device of claim 1, wherein the first inner surface and the second inner surface each include an insert receiver defined in the receiving area to releasably engage the customized portion.

10. The custom feedback device of claim 1, wherein a post extends from each of the first inner surface and the second inner surface within the receiving area to releasable engage the customized portion.

11. The custom feedback device of claim 1, wherein the customized portion includes one or more customized feedback stimuli.

12. The custom feedback device of claim 11, wherein the customized feedback stimuli includes at least one feedback surface.

13. The custom feedback device of claim 1, wherein the customized portion is accessible from an exterior of the shell housing.

14. The custom feedback device of claim 1, wherein at least one of the first outer surface or the second outer surface includes customized feedback stimuli.

15. A custom feedback device comprising:

a first shell having a first inner surface disposed opposite a first outer surface, the first inner surface including at least one of a ridge or a groove;

a first shell opening defined in the first shell and extending through the first shell;

a first protrusion extending from the first inner surface;

a first receiver defined in the first inner surface;

a second shell having a second inner surface disposed opposite a second outer surface;

a second shell opening defined in the second shell and extending through the second shell;

a second protrusion extending from the second inner surface;

a second receiver defined in the second inner surface, the first shell releasably engageable to the second shell to form a shell housing based upon a connection between the first protrusion with the second receiver and the second protrusion with the first receiver, the connection:

forming a horizontally oriented receiving area positioned around a side of the shell housing and defined between the first shell and the second shell; and aligning the first shell opening and the second shell opening to form a vertically oriented opening of space extending through a center of the shell housing; and a customized portion of a plurality of customized portions adapted to be housed at the receiving area based on a feature that mates with the at least one of the ridge or the groove of the first shell based on the feature having a shape complementary to the at least one of the ridge or the groove, wherein:

the customized portion is retained in the receiving area when the first shell and the second shell are engaged, and the customized portion is interchangeable with a second customized portion when the first shell and the second shell are disengaged, the first shell and the second shell being configured to disengage using on a force that overcomes the connection.

* * * * *